US012385191B2

(12) United States Patent
Johnston et al.

(10) Patent No.: US 12,385,191 B2
(45) Date of Patent: Aug. 12, 2025

(54) SUPPORT PRODUCT

(71) Applicant: Rombus World Pty Ltd, Bibra Lake (AU)

(72) Inventors: Brett Jeffrey Johnston, Bibra Lake (AU); Ryan Simmonds, Bibra Lake (AU)

(73) Assignee: Rombus World Pty Ltd, Bibra Lake (AU)

( * ) Notice: Subject to any disclaimer, the term of this patent is extended or adjusted under 35 U.S.C. 154(b) by 533 days.

(21) Appl. No.: 17/822,048

(22) Filed: Aug. 24, 2022

(65) Prior Publication Data

US 2023/0151557 A1 May 18, 2023

(30) Foreign Application Priority Data

Aug. 24, 2021 (AU) ..... 2021221537
Aug. 24, 2021 (AU) ..... 2021902684

(51) Int. Cl.
*E01C 3/00* (2006.01)
*E01C 11/18* (2006.01)
*E01C 15/00* (2006.01)

(52) U.S. Cl.
CPC ..... *E01C 3/003* (2013.01); *E01C 11/18* (2013.01); *E01C 15/00* (2013.01)

(58) Field of Classification Search
CPC ..... E01C 3/003; E01C 11/18; E01C 15/00
USPC ..... 404/31–46
See application file for complete search history.

(56) References Cited

U.S. PATENT DOCUMENTS

| | | | | |
|---|---|---|---|---|
| 7,303,800 | B2 | 12/2007 | Rogers | |
| 8,950,982 | B2 * | 2/2015 | Erez | E02B 5/02 404/70 |
| 9,670,624 | B1 | 6/2017 | Stiles | |
| 10,731,303 | B2 | 8/2020 | Lingle et al. | |
| 2010/0189509 | A1 * | 7/2010 | Filshill | C08K 9/08 977/778 |
| 2012/0057932 | A1 | 3/2012 | Marshall | |
| 2012/0121328 | A1 | 5/2012 | White | |

(Continued)

FOREIGN PATENT DOCUMENTS

| | | |
|---|---|---|
| AU | 2020202478 | 10/2021 |
| CN | 205954439 | 2/2017 |

(Continued)

OTHER PUBLICATIONS

Leek, C, Technical specification for the ground preparation and lay of Rombus Grid [Viewed on internet on Jan. 20, 2022]. URL: https://rombus.com.au/oassolra/2021/04/TA21004_Rombus-Grid-specification_1.1_.pdf published on Jan. 28, 2021.

*Primary Examiner* — Raymond W Addie
(74) *Attorney, Agent, or Firm* — Levine Bagade Han LLP

(57) ABSTRACT

A support product configured to receive poured concrete, the support product comprising a latticework of walls and a plurality of edges, wherein the walls extend between a lower surface and an upper surface and define a plurality of cells, wherein at least one edge comprises a catch and a partial keyway, wherein the catch is configured to connect with a catch of an adjacent support product to restrain relative movement of connected support products, and wherein the partial keyway is configured to be located adjacent to a partial keyway of a connected support product, so that adjacent partial keyways define a complete keyway between connected support products.

20 Claims, 10 Drawing Sheets

(56) References Cited

U.S. PATENT DOCUMENTS

| | | | | |
|---|---|---|---|---|
| 2014/0270945 | A1 | 9/2014 | Bach et al. | |
| 2018/0266057 | A1 | 9/2018 | Park | |
| 2018/0305872 | A1 | 10/2018 | Park | |
| 2019/0345685 | A1 | 11/2019 | Dawson | |
| 2022/0127810 | A1* | 4/2022 | Curson | E02D 3/00 |

FOREIGN PATENT DOCUMENTS

| | | | |
|---|---|---|---|
| DE | 8322275 | U1 | 9/1986 |
| DE | 8622303 | U1 | 10/1986 |
| DE | 10045814 | C1 | 2/2002 |
| DE | 202009012014 | | 1/2010 |
| DE | 202019004560 | | 2/2021 |
| EP | 3199721 | A1 | 2/2017 |
| WO | WO 2002042561 | | 5/2002 |
| WO | WO 2006/100705 | | 9/2006 |
| WO | WO 2008051723 | A2 | 5/2008 |

* cited by examiner

SUPPORT PRODUCT

CROSS-REFERENCE TO RELATED APPLICATION

This application claims priority to Australian Patent Application Nos. 2021221537, filed Aug. 24, 2021; 2021902684, filed Aug. 24, 2021; and 2022221468, filed Aug. 24, 2022; and to New Zealand Patent Application No. 779387, filed Aug. 24, 2021, all of which are incorporated herein by reference in their entireties.

TECHNICAL FIELD

The present disclosure relates to a support product.

More particularly, the present disclosure relates to a support product used in construction of composite concrete trafficable pavements.

BACKGROUND

Traditionally, pavements are constructed as either flexible pavement or rigid pavements, each type of construction having specific benefits and drawbacks.

Pavements as described herein include any trafficable substance laid down on an area intended to sustain vehicular or foot traffic. For example, but not limited to, footpaths, cycle paths, roads, rail track beds, parking lots and runways.

Flexible pavements consist of a sub-base course laid onto subgrade or existing native material, a base course laid on top of the sub-base, and a bituminous surface course laid on the base course.

The surface course consists of one or more bituminous or hot mix asphalt (HMA) layers.

The structural capability of the flexible pavement is determined by the combination of the different layers, and the surface course alone has negligible structural integrity, as the load is distributed into the subjacent layers.

Although by volume the materials required to construct flexible pavements are relatively cheap, the nature of the construction means that, especially in roads requiring high loads, the depth and material volume required is significant, with highways requiring over a metre of additional material to be provided on top of the sub-grade.

Therefore, the cost of construction of flexible pavements, especially those experiencing high loads, is significant.

Similarly, the logistical requirements of getting the required volume of materials to remote locations is also problematic.

Damage to flexible pavements is also common, as the surface course does not have significant structural integrity, and holes can be caused by impacts such as rocks being forced into the surface by traffic loads.

As vehicles pass across the surface course of a flexible pavement, the friction from the tires causes it to expand. Over time, this can lead to surface cracks, allowing water to gradually erode the surface course from underneath, causing larger cracks and pot holes to form.

Where cavities or voids appear in either the base course or sub-base, which may result from a pothole or other defects, repair of the flexible pavement is difficult and costly, as the entire section of pavement must be excavated and re-laid.

The flexible pavement is also affected by extreme temperatures which cause the surface to become tacky which leads to further deterioration.

Rigid pavements, on the other hand, include a surface course, typically in the form of a concrete slab, poured above a base course and possibly a sub-base laid upon the sub-grade.

The rigidity provided by the concrete slab allows the load to be distributed more evenly, potentially allowing for fewer, or shallower, subjacent courses.

Concrete is adversely affected by temperature changes, and expansion and associated cracking must be mitigated by having a number of separate slabs, with adjacent slabs tied together with steel dowels or ties bars or example.

Concrete is also very expensive by volume, and although the construction of a rigid pavement requires less depth than a flexible pavement, the cost of construction is greater by area, primarily due to the concrete required.

Additionally, the logistic of providing concrete to remote locations is significant, and as such, rigid pavements are simply not an option for many remote applications.

Cracking of concrete is common due to high loads, especially towards edges of slabs where the supporting base course may be more susceptible to movement.

Repair of concrete slabs is also more difficult than flexible pavements, as a cracked concrete slab must be cut out and new concrete poured in place, rather than simply filling a small hole with bituminous or HMA product.

In addition, where cavities or subsidence appears in either the base course or sub-base, repair of the rigid pavement is difficult and costly, as the entire section of pavement must be excavated and re-laid.

Consideration of cost alone allows a determination to be made on the cheapest option for type of pavement, with soil CBR (California Bearing Ratio) and traffic load in MSA (Million Standard Axles) being contributing factors.

However, rigid pavements require significantly higher $CO_2$ emissions, with the total emissions during construction being 5 to 6 times higher than flexible pavements, largely due to the concrete volumes.

In summary, known methods of construction of pavements are costly, requiring large material volumes and $CO_2$ emissions, and are difficult to repair.

It is to be understood that, if any prior art publication is referred to herein, such reference does not constitute an admission that the publication forms a part of the common general knowledge in the art, in Australia or any other country.

SUMMARY

In some embodiments, there is provided a support product. The support product may comprise a plurality of walls. At least some of the plurality of walls may define cells. The plurality of walls may comprise: an edge wall defining an edge plane that is parallel to the edge wall; and a plurality of partial keyway walls defining a partial keyway. The plurality of partial keyway walls may comprise: a pair of offset partial keyway walls that extend parallel to a first direction that is transverse to the edge plane; and a transverse partial keyway wall extending from one of the pair of offset partial keyway walls to the other of the pair of offset partial keyway walls.

In some embodiments, the pair of offset partial keyway walls comprises: a first partial keyway wall, the first partial keyway wall extending from a first junction to a second junction, the first junction being a junction between the first partial keyway wall and the edge wall and the second junction being a junction between the first partial keyway wall and the transverse partial keyway wall; and a second partial keyway wall, the second partial keyway wall extending from a third junction to a wall end portion, the third junction being a junction between the transverse partial keyway wall and the second partial keyway wall.

In some embodiments, a keyway opening is defined between the first junction and the wall end portion.

In some embodiments, the first partial keyway wall and the edge wall define an acute angle therebetween.

In some embodiments, the first partial keyway wall and the transverse partial keyway wall define an acute angle therebetween.

In some embodiments, the transverse partial keyway wall and the second partial keyway wall define an obtuse angle therebetween.

In some embodiments, the second partial keyway wall is longer than the first partial keyway wall.

In some embodiments, there is provided a support product. The support product may comprise: a plurality of walls defining cells; and a partial keyway that is configured to receive part of a key. The partial keyway may extend inwardly from an edge of the support product. The partial keyway may be configured to inhibit outward motion of the key when the part of the key is within the partial keyway.

In some embodiments, the partial keyway is defined by a plurality of partial keyway walls.

In some embodiments, there is provided a support product. The support product may comprise: a plurality of cells; and a plurality of partial keyway walls defining a partial keyway. The support product may be configured to be aligned with a second support product such that the partial keyway and a second partial keyway of the second support product form a keyway configured to receive a key. In use, the partial keyway walls may be configured to cooperate with the key to inhibit relative movement of the support product and the second support product.

In some embodiments, the partial keyway extends inwardly from an edge of the support product.

In some embodiments, there is provided a support product. The support product may comprise: a plurality of walls at least partially defining a cell structure that comprises a plurality of cells, the cell structure being repeated throughout at least part of the support product. Each wall of the plurality of walls may meet another wall of the plurality of walls at a junction. A perimeter profile of the cell structure may be determined by connecting the junctions with straight lines forms an asymmetric polygon.

In some embodiments, each instance of the cell structure shares at least one wall in common with another instance of the cell structure.

In some embodiments, one or more of the cells of the cell structure is a quadrilateral.

In some embodiments, one or more of the cells of the cell structure is symmetrical.

In some embodiments, one or more of the cells of the cell structure is regular.

In some embodiments, the cell structure comprises: a first group of cells that comprises a first axis of symmetry; and a second group of cells that comprises a second axis of symmetry.

In some embodiments, the first group of cells is symmetric with respect to the second group of cells about a third axis of symmetry.

In some embodiments, the plurality of cells comprises a first cell of a first shape, the first shape being defined, at least in part, by a first subset the plurality of walls.

In some embodiments, the plurality of cells comprises a second cell of a second shape, the second shape being defined, at least in part, by a second subset the plurality of walls, the second subset comprising at least one wall of the first subset.

In some embodiments, the first group of cells comprises the first cell and the second cell.

In some embodiments, the first cell and the second cell share a wall of the plurality of walls.

In some embodiments, the first axis of symmetry extends along at least part of the shared wall.

In some embodiments, the plurality of cells comprises a third cell of a third shape, the third shape being defined by a third subset of the plurality of walls, the third subset comprising at least one wall from the first subset and at least one wall from the second subset.

In some embodiments, the plurality of cells comprises a fourth cell of a fourth shape, the fourth shape being defined, at least in part, by a fourth subset the plurality of walls.

In some embodiments, the plurality of cells comprises a fifth cell of a fifth shape, the fifth shape being defined, at least in part, by a fifth subset the plurality of walls, the fifth subset comprising at least one wall of the fourth subset.

In some embodiments, the plurality of cells comprises a sixth cell of a sixth shape, the sixth shape being defined, at least in part, by a sixth subset of the plurality of walls, the sixth subset comprising at least one wall of the fifth subset.

In some embodiments, the second group of cells comprises the fourth cell and the fifth cell.

In some embodiments, the fourth cell and the fifth cell share a wall of the plurality of walls.

In some embodiments, the second axis of symmetry extends along at least part of the shared wall.

In some embodiments, the third axis of symmetry bisects the third cell.

In some embodiments, the support product further comprises a partial keyway that is configured to receive part of a key. The partial keyway may extend inwardly from an edge of the support product. The partial keyway may be configured to inhibit outward motion of the key when the part of the key is within the keyway.

In some embodiments, the partial keyway is defined by a plurality of partial keyway walls.

In some embodiments, the cells are configured to receive a fill material.

In some embodiments, the partial keyway defines a reentrant corner of the support product.

In some embodiments, the support product further comprises a male catch that projects outwardly. The male catch may comprise: an outer catch portion of a first width; and an inner catch portion of a second width. The first width may be greater than the second width.

In some embodiments, the male catch projects outwardly from one of the minor faces.

In some embodiments, the support product further comprises a female catch in the form of a groove in one of the walls of the plurality of walls.

In some embodiments, the support product comprises opposed major faces comprising a first major face and a second major face.

In some embodiments, the support product comprises a plurality of edge regions.

In some embodiments, each edge region comprises a respective minor face of the support product.

In some embodiments, one of the edge regions comprises the partial keyway.

In some embodiments, the support product comprises a plurality of male catches and a plurality of female catches. The plurality of male catches may project outwardly from one or more walls of one of the edge regions. The plurality of female catches may be located on one or more walls of an edge region that is adjacent to the edge region from which the plurality of male catches project outwardly.

In some embodiments, the support product is rectangular and comprises four edge regions.

In some embodiments, the edge region that comprises the partial keyway also comprises the edge wall.

In some embodiments, one or more of the plurality of walls extends at least partially between the first major face and second major face.

In some embodiments, one or more of the plurality of walls extends from the first major face to the second major face.

In some embodiments, one or more of the cells extends at least partially between the first major face and the second major face.

In some embodiments, one or more of the cells extends from the first major face to the second major face.

In some embodiments, the support product comprises: a plurality of partial keyways that comprises the partial keyway; and one or more additional partial keyways.

In some embodiments, each edge region comprises at least one partial keyway of the plurality of partial keyways.

In some embodiments, the support product further comprises an access cell that is configured to enable access beneath the support product.

In some embodiments, a junction between a number of the walls of the plurality of walls comprises the access cell.

In some embodiments, a cross-sectional profile of the access cell is circular.

In some embodiments, the access cell comprises inwardly projecting projections.

In some embodiments, one or more of the plurality of walls has a height that is between 20 mm and 100 mm.

In some embodiments, one or more of the plurality of walls is thicker at a lower portion than at a higher portion.

In some embodiments, the support product further comprises a planar portion. The planar portion may extend generally parallel to the axes of a reference plane. The planar portion may comprise one or more channels extending from one face of the planar portion and an opposing face of the planar portion. The one or more channels may be aligned with one or more respective cells of the support product, providing a hole therethrough.

In some embodiments, the support product comprises a polymer.

In some embodiments, there is provided a pavement course comprising the support product.

In some embodiments, the pavement course further comprises the fill material. The cells may contain the fill material. The fill material may comprise one or more of: a cementitious material; a bituminous material; and a granular fill material.

In some embodiments, there is provided a path comprising the support product.

In some embodiments, the path may further comprise the fill material. The cells may contain the fill material. The fill material may comprise one or more of: a cementitious material; a bituminous material; and a granular fill material.

In accordance with one aspect of the present disclosure, there is provided a support product configured to receive poured concrete, the support product comprising a latticework of walls and a plurality of edges, wherein the walls extend between a lower surface and an upper surface and define a plurality of cells, wherein at least one edge comprises a catch and a partial keyway, wherein the catch is configured to connect with a catch of an adjacent support product to restrain relative movement of connected support products, and wherein the partial keyway is configured to be located adjacent to a partial keyway of a connected support product, so that adjacent partial keyways define a complete keyway between connected support products.

In some embodiments, the support product is constructed of polymer.

In some embodiments, the support product is rectangular and comprises four edges.

In some embodiments, each edge comprises at least one catch and at least one partial keyway, wherein partial keyways of opposed edges are symmetrical.

In some embodiments, each edge comprises at least two partial keyways.

In some embodiments, each edge comprises at least four partial keyways.

In some embodiments, each edge comprises at least two catches.

In some embodiments, each edge comprises at least four catches.

In some embodiments, each catch is either a first part or a second part.

In some embodiments, the first part is a male pin and the second part is a female slot.

In some embodiments, the first part is an over hook and the second part is an under hook.

In some embodiments, a pair of adjacent edges of the support product comprises catches having a first part, and an opposed pair of adjacent edges of the support product comprises catches having a second part, to facilitate assembly of a large number of support products.

In some embodiments, each catch is comprised of a slot, and support products are connected using an intermediary connector.

In some embodiments, the intermediary connector is cotton reel shaped, having wider ends and a narrower mid-portion.

In some embodiments, partial keyways of adjacent support products define a complete keyway having a shape configured to prevent separation of adjacent support products.

In some embodiments, partial keyways of adjacent support products define a complete keyway having a chevron shaped section.

In some embodiments, the support product is symmetrical about both a horizontal centreline and a vertical centreline.

In some embodiments, the support product further comprises a cylindrical access cell, to facilitate access below the support product.

In some embodiments, the cylindrical access cell comprises protrusions into the cell to retain the hardened concrete cylinder and prevent it from being accidentally ejected.

In some embodiments, the latticework of walls is between 20 mm and 100 mm high.

In some embodiments, the latticework of walls is between 30 mm and 50 mm high.

In some embodiments, the walls of the latticework are of substantially identical cross-section.

In some embodiments, the walls of the latticework comprise a T section, wherein the wall includes a wider section at the lower surface, to provide additional weight bearing capability when not filled with concrete.

In accordance with another aspect of the present disclosure there is provided a pavement course comprising a plurality of connected support products, wherein each support product comprises; a latticework of walls and a plurality of edges, wherein the walls extend between a lower surface and an upper surface and define a plurality of cells, wherein at least one edge comprises a catch and a partial keyway, wherein adjacent support products are connected by respective catches to restrain relative movement, and wherein the partial keyway is located adjacent to a partial keyway of a connected support product, so that adjacent partial keyways define a complete keyway between connected support products, and wherein the pavement course comprises concrete extending from the lower surface to the upper surface so that the cells and keyways are substantially filled with concrete.

In some embodiments, the pavement course further comprises an edge formwork piece configured to connect to catches of the support products, wherein the edge formwork pieces define an edge of the pavement course.

In some embodiments, the edge formwork piece is constructed of a constant section, having a slot configured to receive an intermediary connector.

In some embodiments, the edge formwork piece comprises catches configured to connect with catches of the support product.

In accordance with another aspect of the present disclosure there is provided a method of constructing a pavement course, wherein the pavement course comprises a plurality of connected support products, wherein each support product comprises; a latticework of walls and a plurality of edges, wherein the walls extend between a lower surface and an upper surface and define a plurality of cells, wherein at least one edge comprises a catch and a partial keyway, and wherein each partial keyway is configured to be located adjacent to a partial keyway of a connected support product, so that adjacent partial keyways define a complete keyway between connected support products, and wherein the method comprises the following steps:

a. Connecting a plurality of support products using adjacent catches, to create an array substantially spanning an area for which the pavement course is to be provided,
b. Pouring concrete onto the array, so that the cells and complete keyways of the array of support products are substantially filled with concrete,
c. Allowing the concrete to set.

In some embodiments, the method comprises the following step after step b:

bi. Levelling the upper surface using a vibrating screed.

In some embodiments, the method further comprises the following step after step c:

ci. once the concrete has hardened, finishing the upper surface using a chopper.

In accordance with another aspect of the present disclosure there is provided a method of repairing a void in a pavement course, wherein the pavement course comprises a plurality of connected support products, wherein each support product comprises; a latticework of walls, a cylindrical access cell and a plurality of edges, wherein the walls extend between a lower surface and an upper surface and define a plurality of cells, wherein at least one edge comprises a catch and a partial keyway, wherein adjacent support products are connected by respective catches to restrain relative movement, and wherein the partial keyway is located adjacent to a partial keyway of a connected support product, so that adjacent partial keyways define a complete keyway between connected support products, and wherein the pavement course comprises concrete extending from the lower surface to the upper surface so that the cells and keyways are substantially filled with concrete, and wherein the method comprises the following steps:

a. Drilling through the concrete of a cylindrical access cell, wherein the cylindrical access cell is located above the void to be repaired
b. Injecting filler product (not shown) into the void until the void, and the cylindrical access cell are substantially filled.

In some embodiments, the filler product is selected from a list comprising; non-shrink construction grout, expanding foam, expanding polymer based grouts and other chemical grouts.

BRIEF DESCRIPTION OF DRAWINGS

The present disclosure will now be described, by way of example, with reference to the accompanying drawings, in which.

DETAILED DESCRIPTION

Figure 1A:
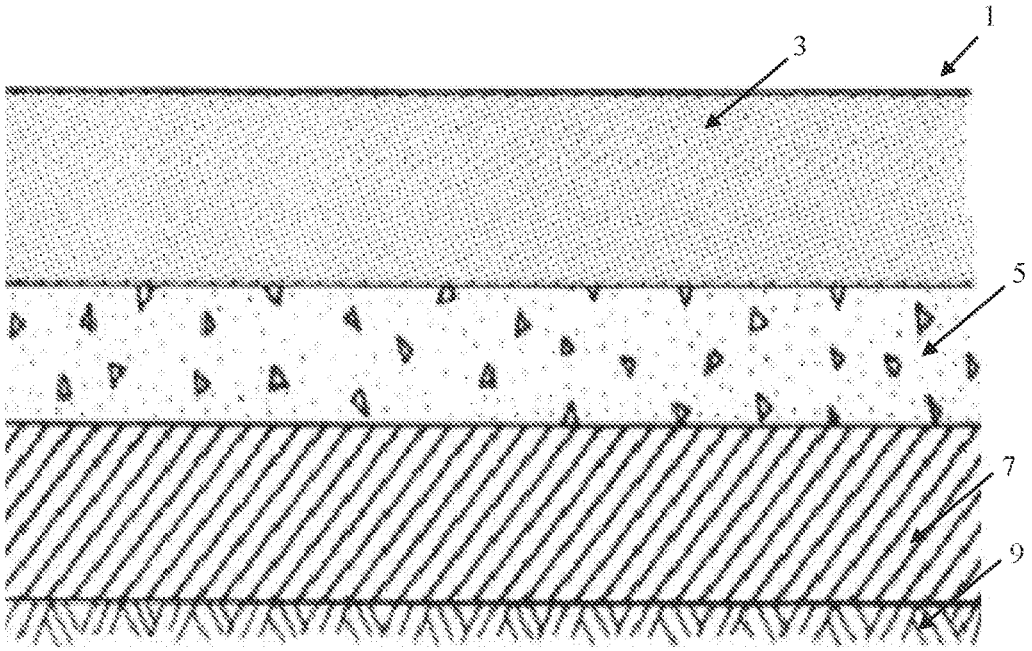
FIG. 1*a* is a cross-section of a conventional construction of a flexible pavement, showing the different courses of material.
Figure 1B:
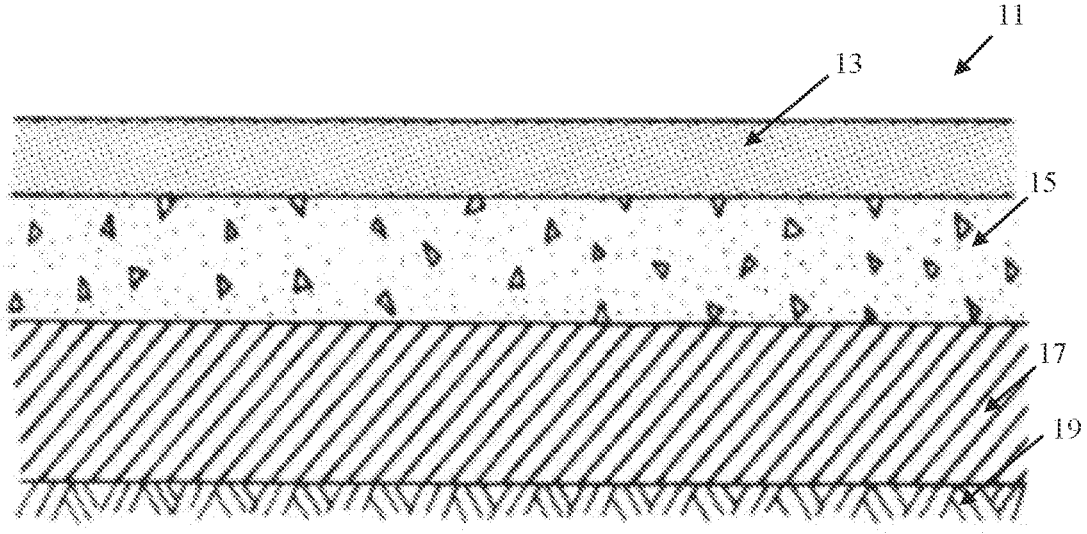
FIG. 1*b* is a cross-section of a conventional construction of a rigid pavement, showing the different courses of material.

FIG. 1*a* shows a conventionally constructed flexible pavement 1. The flexible pavement comprises a surface course 3, a base course 5 and a sub-base 7 provided on top of a subgrade 9. It will be understood that the sub-base 7 may be optional. FIG. 1*b* shows a conventionally constructed rigid pavement 11. The rigid pavement 11 comprises a surface course 13, a base course and a sub-base 17 provided on top of subgrade 19. It will be understood that the sub-base 17 may be optional.

Figure 1C:
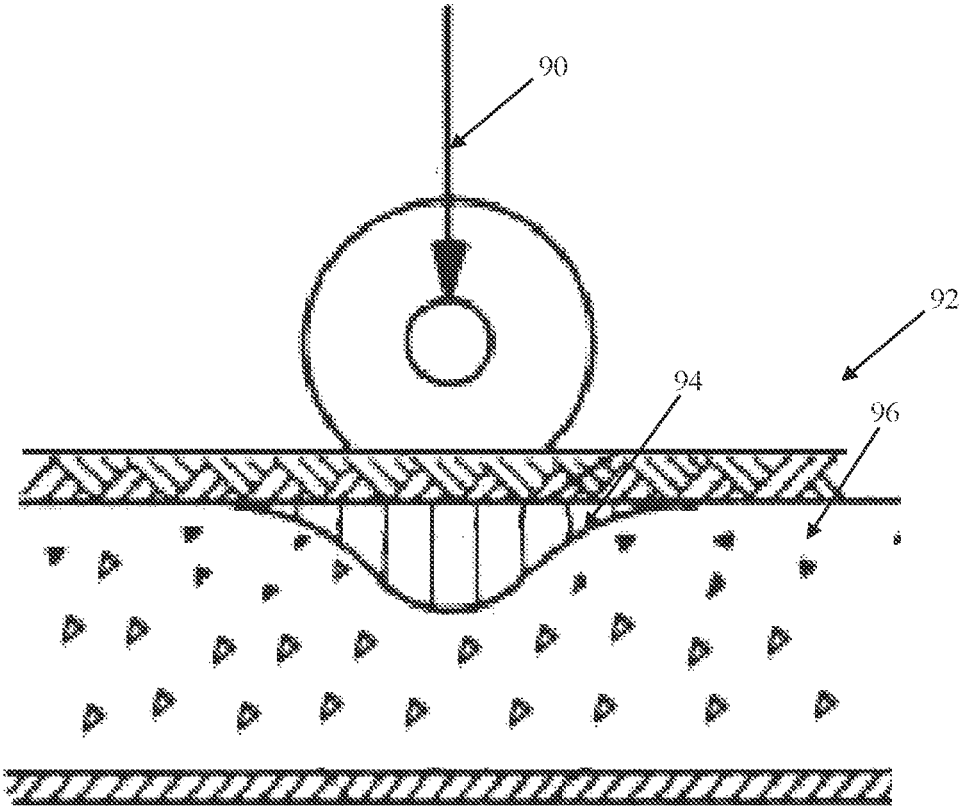
FIG. 1*c* is a cross-section of a conventional construction of a flexible pavement, showing the load applied by a wheel and how this can affect the subjacent course, creating a void, exemplary of a problem experienced by such pavements.
Figure 1D:
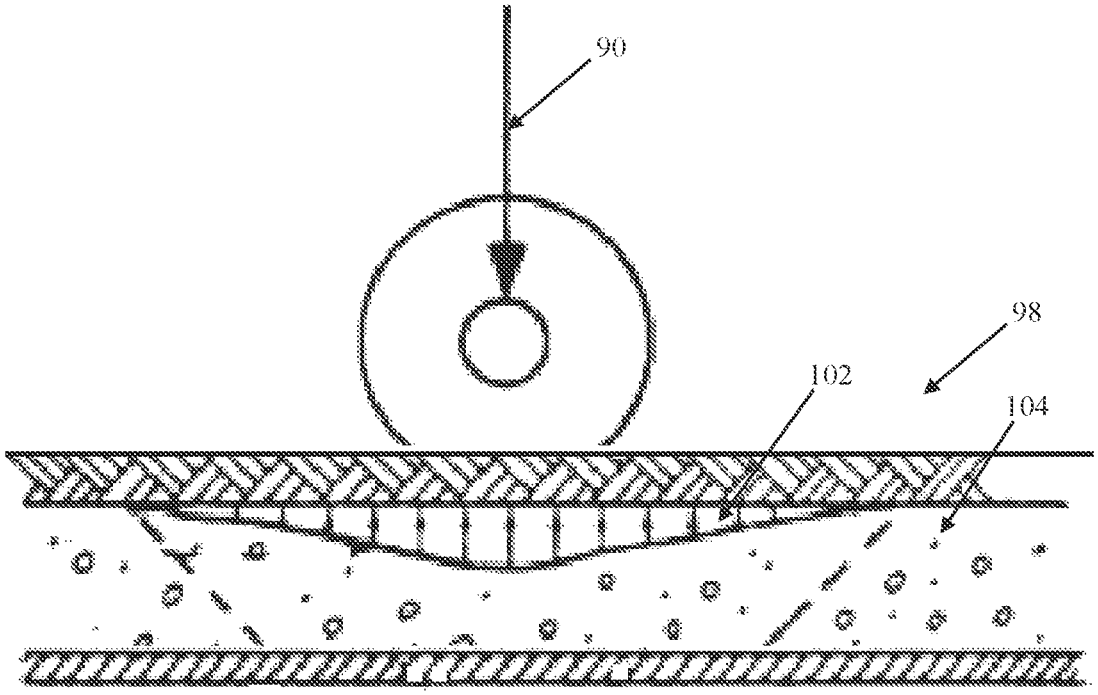
FIG. 1*d* is a cross-section of a conventional construction of a rigid pavement, showing the load applied by a wheel and how this can affect the subjacent course, creating a void, exemplary of a problem experienced by such pavements.

FIG. 1*c* shows a typical load 90 applied to a conventionally constructed flexible pavement 92. FIG. 1*c* also shows a distribution 94 of this load 90 into a base course 96 or other subjacent course. FIG. 1*d* shows the typical load 90 applied to a conventionally constructed rigid pavement 98. FIG. 1*d* also shows a distribution 102 of this load 90 into a base course 104 or other subjacent course.

Support Product

Referring to FIGS. 2 to 5, there is shown a support product 10. The support product 10 may be in the form of a panel. The support product 10 is configured to receive a fill material. The fill material may comprise one or more of a cementitious material, a bituminous material and a granular fill material. Therefore, in some embodiments, the support product 10 is configured to receive poured concrete.

The support product 10 is configured to be connected to a plurality of additional support products 10. Once connected, the fill material is provided to the support products 10. The fill material may comprise one or more of a cementitious material such as cement, a bituminous material such as asphalt, and a granular fill material such as gravel. The filled support product 10 provides part of a path for the conveyance of traffic. As described herein, existing flexible pavements require a significant volume of material and depth, with an associated significant cost of construction. Damage to flexible pavements is also common. Rigid pavements are adversely affected by temperature changes, which can cause expansion and subsequent cracking of the rigid pavements. Rigid pavements can also be relatively expensive to construct and difficult to repair. The support product 10 described herein can enable the construction of a path such as a pavement for the conveyance of traffic that provides benefits that are typically only provided by one of flexible pavements or rigid pavements, as described in more detail below.

The support product 10 is configured to receive poured concrete. While described in the context of poured concrete, it will be understood that the support product 10 is also configured to receive other fill materials. The support product 10 comprises a latticework of walls 20 and a plurality of edges, wherein the walls 20 extend between a lower surface and an upper surface and define a plurality of cells 26, wherein at least one edge comprises a catch and a partial keyway 50, wherein the catch is configured to connect with a catch of an adjacent support product 10 to restrain relative movement of connected support products 10, and wherein the partial keyway 50 is configured to be located adjacent to a partial keyway 50 of a connected support product 10, so that adjacent partial keyways 50 define a complete keyway 55 between connected support products 10.

The support product 10 comprises a pair of opposed major faces 14, 16. The pair of opposed major faces 14, 16 comprises a first major face 14 and a second major face 16. The first major face 14 is parallel to the second major face 16. The support product 10 is generally rectangular. Therefore, the first major face 14 and the second major face 16 are generally rectangular. It is acknowledged that the term rectangular as used herein also includes square.

Figure 5A:
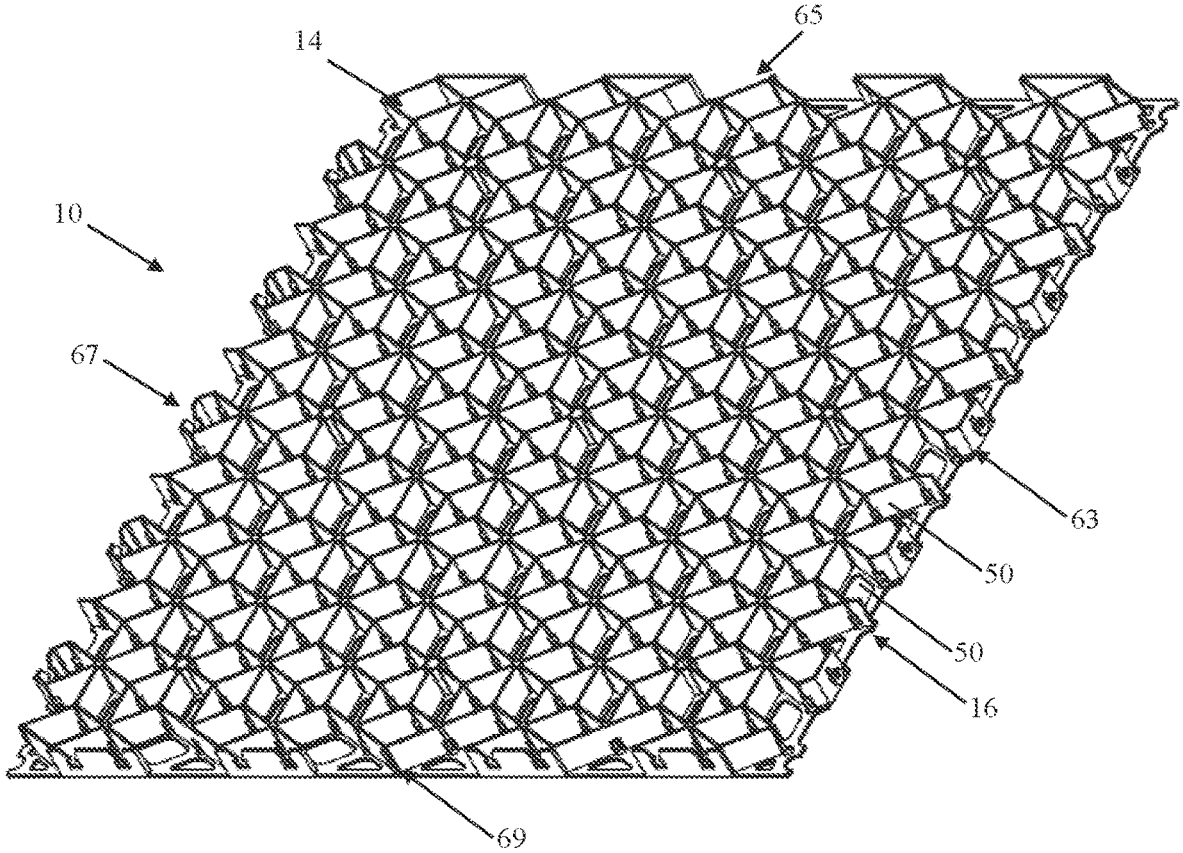
FIG. 5A is an isometric view showing a support product according to an embodiment of the present disclosure.
Figure 5B:
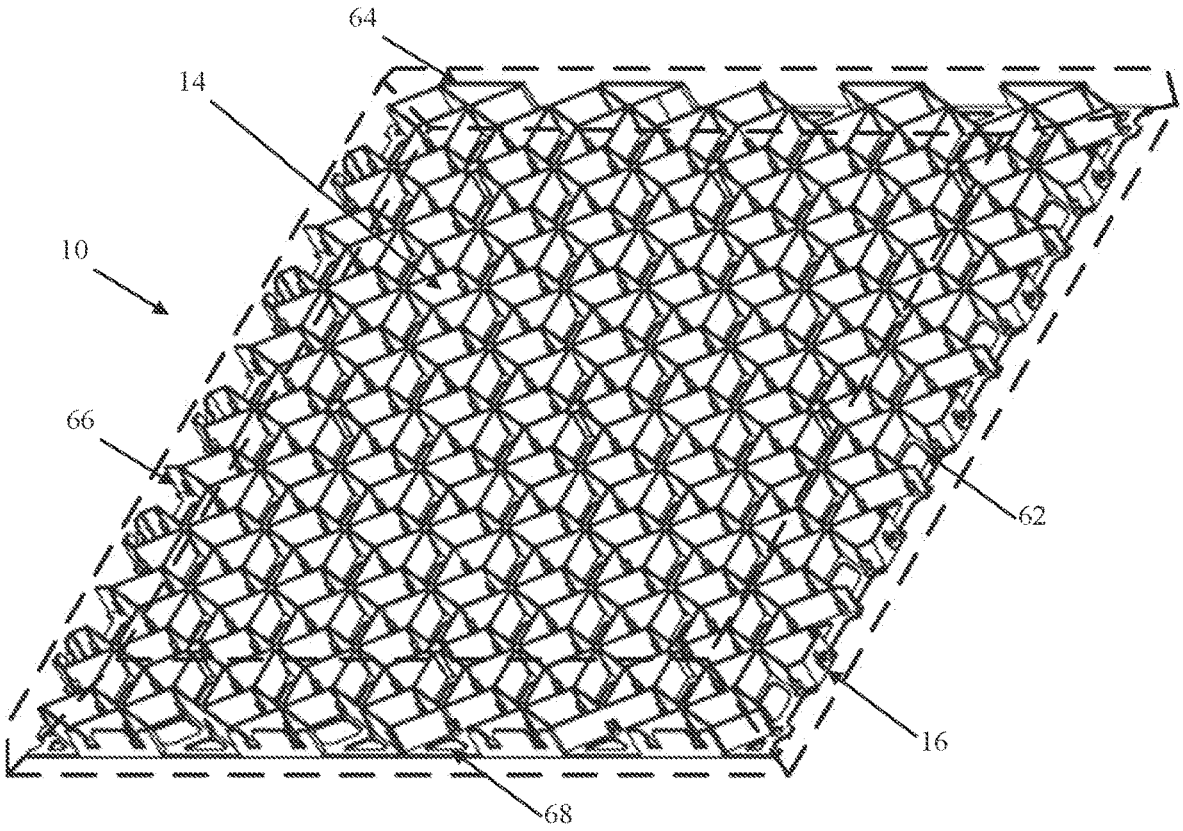
FIG. 5B is an isometric view of the support product of FIG. 5A showing a number of edge regions.

The support product 10 comprises a plurality of edge regions 62, 64, 66, 68 (see FIG. 5B). The illustrated support product 10 comprises four edge regions 62, 64, 66, 68. The support product 10 comprises a first edge region 62. The support product comprises a second edge region 64. The second edge region 64 is adjacent to the first edge region 62. The support product comprises a third edge region 66. The third edge region 66 is adjacent to the second edge region 64. The support product comprises a fourth edge region 68. The fourth edge region 68 is adjacent to the third edge region 66 and the first edge region 62.

In some embodiments, the edge regions 62, 64, 66, 68 may be referred to as edges. In other words, in some embodiments, the support product 10 comprises a plurality of edges 30. Therefore, the support product 10 may be said to be rectangular and comprise four edges.

The support product 10 comprises a plurality of minor faces 63, 65, 67, 69. The support product 10 comprises a first minor face 63. The first edge region 62 comprises the first minor face 63. The support product 10 comprises a second minor face 65. The second edge region 64 comprises the second minor face 65. The second minor face 65 is orthogonal to the first minor face 63. The support product 10 comprises a third minor face 67. The third edge region 66 comprises the third minor face 67. The third minor face 67 is orthogonal to the second minor face 65. The third minor face 67 is parallel to the first minor face 63. The support product comprises a fourth minor face 69. The fourth edge region 68 comprises the fourth minor face 69. The fourth minor face 69 is parallel to the second minor face 65. The fourth minor face 69 is orthogonal to the first minor face 63 and the third minor face 67.

Each of the plurality of minor faces 63, 65, 67, 69 can be considered to define an edge of the support product.

The support product 10 comprises a plurality of walls 20. The walls 20 extend at least partially between the first major face 14 and the second major face 16. In some embodiments, one or more of the walls 20 extend from the first major face 14 to the second major face 16. The support product 10 comprises a plurality of cells 26. The walls 20 meet at junctions to form the cells 26. In other words, the plurality of cells 26 are defined by the walls 20.

In some embodiments, the walls 20 may be said to extend between a lower surface and an upper surface to define the plurality of cells 26. That is, each wall 20 may be said to extend from a lower surface (of that wall 20) to an upper surface (of that wall 20) to define at least part of a respective cell 26.

Figure 6:
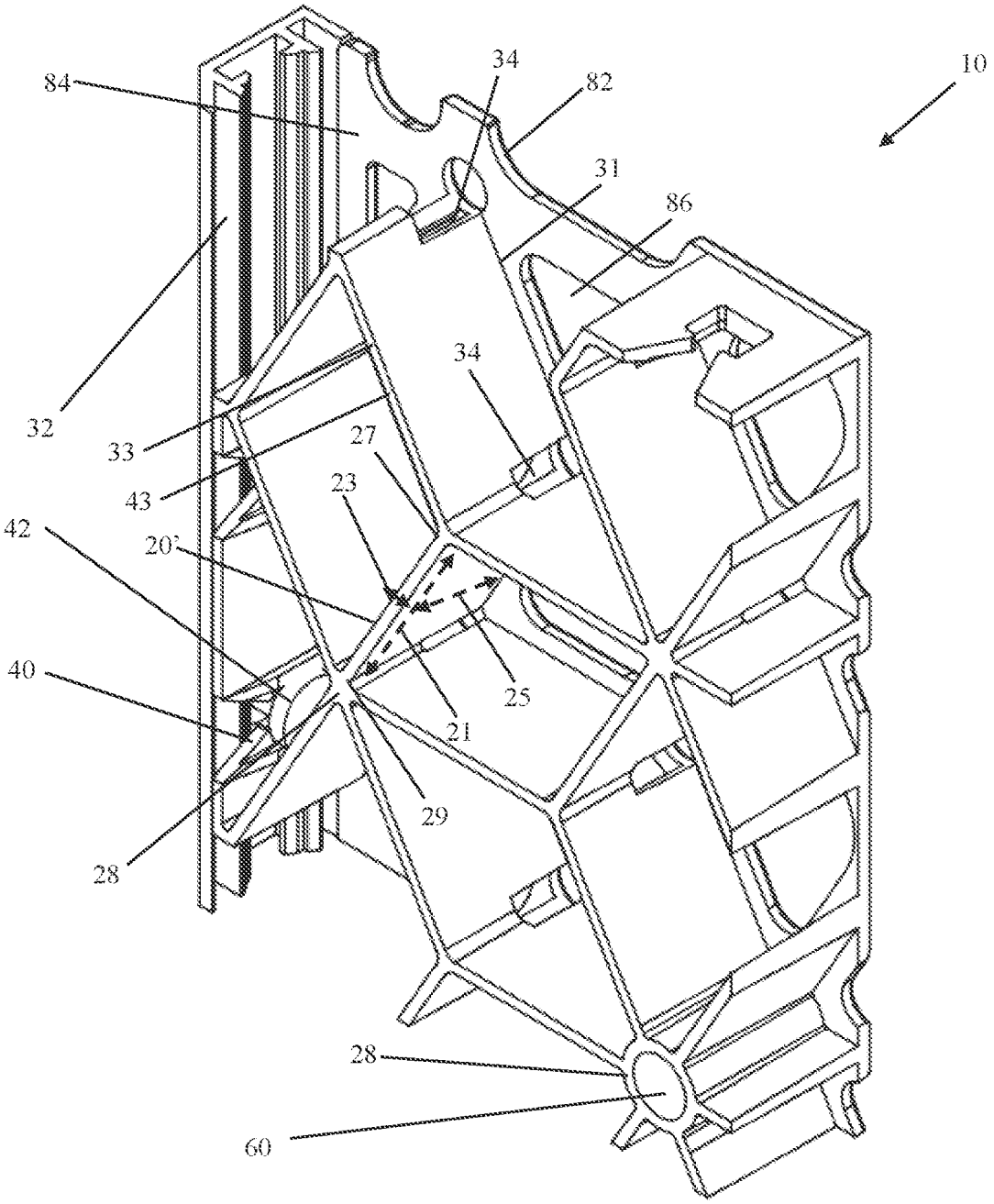
FIG. 6 is an isometric view showing an edge formwork piece connected to a support product according to an embodiment of the present disclosure.

Each wall 20 extends, to some extent, along a respective longitudinal axis 21, lateral axis 23 and vertical axis 25. By way of example, the longitudinal axis 21, lateral axis 23 and vertical axis 25 of wall 20' are shown in FIG. 6. Each of the longitudinal axis 21, lateral axis 23 and vertical axis 25 of a particular wall 20 are orthogonal with respect to the other two axes. As the orientation of various walls 20 is different, each wall 20 may be considered to have its own associated longitudinal axis 21, lateral axis 23 and vertical axis 25.

Each wall 20 has a pair of major wall faces. Each wall 20 has an associated thickness at each portion of the wall 20. The thickness of a portion of a wall 20 may be considered to be a dimension of the relevant wall 20 at that portion, measured in a direction parallel to the lateral axis 23 of the wall 20. In some embodiments, the thickness of a particular portion of a wall 20 may be considered to be the shortest distance between the major faces of the wall 20 at that portion.

One or more of the walls 20 can be considered to have a first longitudinal end 27 and a second longitudinal end 29. Each wall 20 has an associated length. The length of a particular wall 20 may be considered to be a distance between the first longitudinal end 27 of the relevant wall 20 and the second longitudinal end 29 of that wall 20 (see FIG. 5) measured in a direction parallel to the longitudinal axis 21. As described herein, a number of the walls 20 meet other walls 20 at one or more junctions 28. In some embodiments, the end of a wall 20 may be considered to be taken as a centre point of the relevant junction 28. In some embodiments, the end of a wall 20 may be considered to be where the wall meets the junction 28.

One or more of the walls 20 can be considered to have a base end 31 and an elevated end 33. Each wall 20 has an associated height. The height of a particular wall 20 may be considered to be a distance between the base end 31 and the elevated end 33.

Each cell 26 has at least one cell opening. The cells 26 are configured to receive the fill material via the cell opening(s). The walls 20 define the cell openings. In the illustrated embodiment, each cell 26 comprises a first cell opening 35. The first cell opening 35 is defined by the elevated end 33 of the walls 20 defining the relevant cell 26. Each cell 26 also comprises a second cell opening 37. The second cell opening 37 is defined towards the base end 31 of the walls 20 defining the relevant cell 26. Each cell 26 of the illustrated embodiment defines a channel. The cells 26 extend at least partially between the first major face 14 and the second major face 16. In the illustrated embodiment, the cells 26 extend from the first major face 14 to the second major face 16. The cells of the illustrated embodiment therefore define channels that fluidly connect the first major face 14 and the second major face 14 of the support product 10.

In some embodiments, the wall thickness of one or more of the walls 20 is constant. In some embodiments, the thickness of one or more of the walls 20 may change across the wall 20. For example, in some embodiments, the thickness of one or more of the walls 20 may increase along at least part of the wall 20 from near or at the base end 31 towards the elevated end 33. In other words, the thickness of one or more of the walls 20 may be greater at the elevated end 33 than near or at the base end 31. In some embodiments, the thickness of one or more of the walls 20 may decrease along the wall from the base end 31 to the elevated end 33. In other words, the thickness of one or more of the walls 20 may be lower at the elevated end 33 than at the base end 31.

One or more of the walls includes an opening 34 (see FIG. 5). In particular, one or more of the walls includes a plurality of openings 34. In the illustrated embodiment, the walls 20 that define the cells 26 comprise two openings 34 each. The openings fluidly connect the cells 26. That is, the openings 34 enable a fluid contained in one cell 26 to move to an adjacent cell 26, via the openings 34. The openings 34 are located at the longitudinal ends 27, 29 of the walls 20. The openings 34 are located closer to the base end 31 of the walls 20 than the elevated end 33. In some embodiments, the openings 34 extend from at or near the base end of the walls 20, towards the elevated end 33, at the longitudinal ends 27, of the walls 20.

In some embodiments, it will be appreciated that the one or more of the walls 20 do not comprise the openings 34.

As described herein, the walls 20 of the support product 10 define a latticework. In some embodiments, a height of the support product 10 is between 20 mm and 100 mm or between 30 mm and 50 mm. In some embodiment, one or more of the walls 20 has a height between 20 mm and 100 mm or between 30 mm and 50 mm. In some embodiments, the latticework of walls 20 may be between 20 mm and 100 mm high. In some embodiments, the latticework of walls 20 may be between 30 mm and 50 mm high.

The walls 20 may be of substantially identical cross-section.

The support product 10 may be symmetrical about both a horizontal centreline and a vertical centreline.

In some embodiments, the support product 10 comprises a polymer. The support product 10 may be constructed of polymer. The support product 10 may be a constructed of a composite material comprising a polymer.

Repeated Cell Structure

Figure 2:
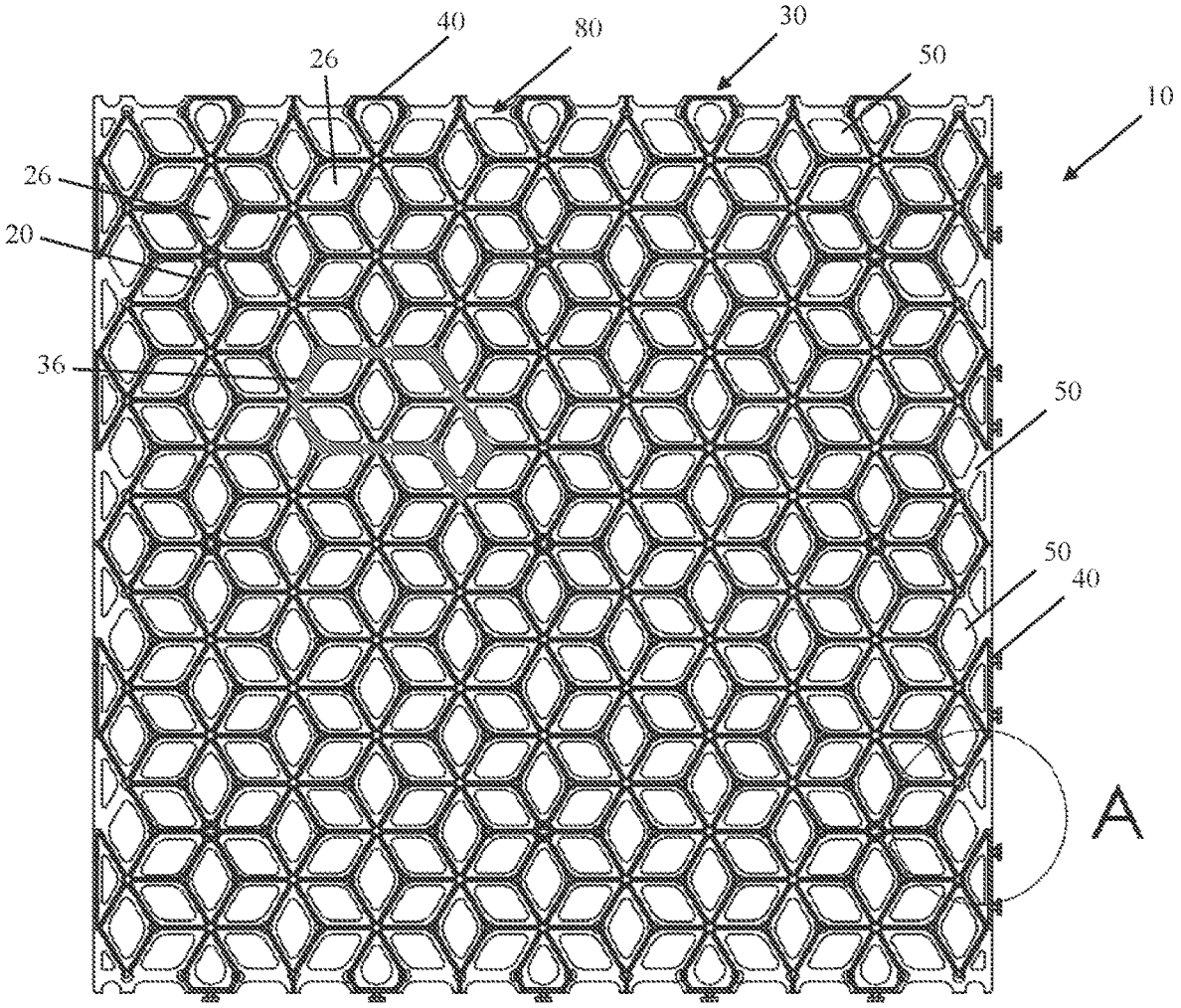
FIG. 2 is a plan view of a support product according to an embodiment of the present disclosure, with a region identified as 'A'.

At least some of the plurality of walls 20 define at least part of the cells 26. The cells 26 are configured to receive the fill material. Each cell 26 may be said to have a three-dimensional shape. The three-dimensional shape of a cell 26 corresponds to the three-dimensional volume of the cell 26, as defined at least partly by the relevant walls 20. Each cell 26 may also be said to have a planar profile 39. The planar profile 39 of a cell 26 may be referred to as a cell planar profile. The planar profile 39 of a cell 26 is the profile of the cell 26, when viewed from a plan view (i.e. from above, as shown in FIG. 2). The planar profile 39 of a cell 26 may be a function of the height of the cell 26. That is, as the height of the cell is transited (e.g. from the base end 31 to the elevated end 33, the planar profile 39 of the cell may vary (e.g. with varying thickness of the walls 20 defining the cell 26).

As described herein, one or more of the walls 20 of the plurality of walls 20 of the support structure 10 meets another wall 20 of the plurality of walls 20 at a junction 28. The junctions 28 can be used as reference points to define a planar shape of the cells 26. Specifically, a cell perimeter profile 38 can be determined by connecting the junctions 28 of a respective cell 26 with straight lines. The cell perimeter profiles 38 described herein are determined by connecting the junctions 28 of the cells 26 at the elevated end 33 of the walls 20. It will be understood however, that the cell perimeter profiles 28 may be determined in a similar way at a different elevation (e.g. at a point between the base end 31 and the elevated end 33 of the walls).

In the illustrated embodiment, the perimeter profiles 38 of the cells 26 are quadrilateral. It will be understood that in some embodiments, one or more of the cells 26 may have a perimeter profile 38 that is not a quadrilateral. For example, the perimeter profile 38 may be another polygonal profile (e.g. triangular or hexagonal). In some embodiments, the perimeter profile 38 may be an asymmetric polygon.

Each cell 26 has a respective cell planar profile 39. The cell planar profile 39 of a particular cell 26 is the profile defined by the surfaces of the walls 20 that define that cell 26. Such wall 20 surfaces may be referred to as 'inner surfaces' with respect to the particular cell 26. One or more of the cells 26 has a quadrilateral cell planar profile 39. In particular, one or more of the cells 26 has a cell planar profile 39 resembling a rhombus.

It will be understood that geometric terms such as 'polygon', 'quadrilateral' and 'rhombus' used herein are intended to be generally indicative of a particular geometry, without excluding other similar geometries. For example, where the term quadrilateral is used herein, it will be understood that the relevant quadrilateral geometry does not necessarily need precisely defined corners to fall within the scope of the term quadrilateral. That is, the term quadrilateral herein is intended to include rounded quadrilaterals (i.e. quadrilaterals with rounded corners) and other minor variations to the specific geometric definition of a quadrilateral as being a shape with 4 straight sides and 4 corners. For example, referring to cell 26B of FIG. 4, it can be seen that the planar profile of the cell includes 4 straight edges, 3 rounded corner regions and a corner region that is defined in part by a wall 20 defining a circular junction 28. Herein, shapes such as this will be described as quadrilateral, or as a polygon, as their prominent features resemble that of a quadrilateral and/or a polygon (i.e. 4 straight edges), even if such shapes do not necessarily meet the strict mathematical definition of a quadrilateral and/or polygon requiring a number precisely defined corners.

Figure 4:
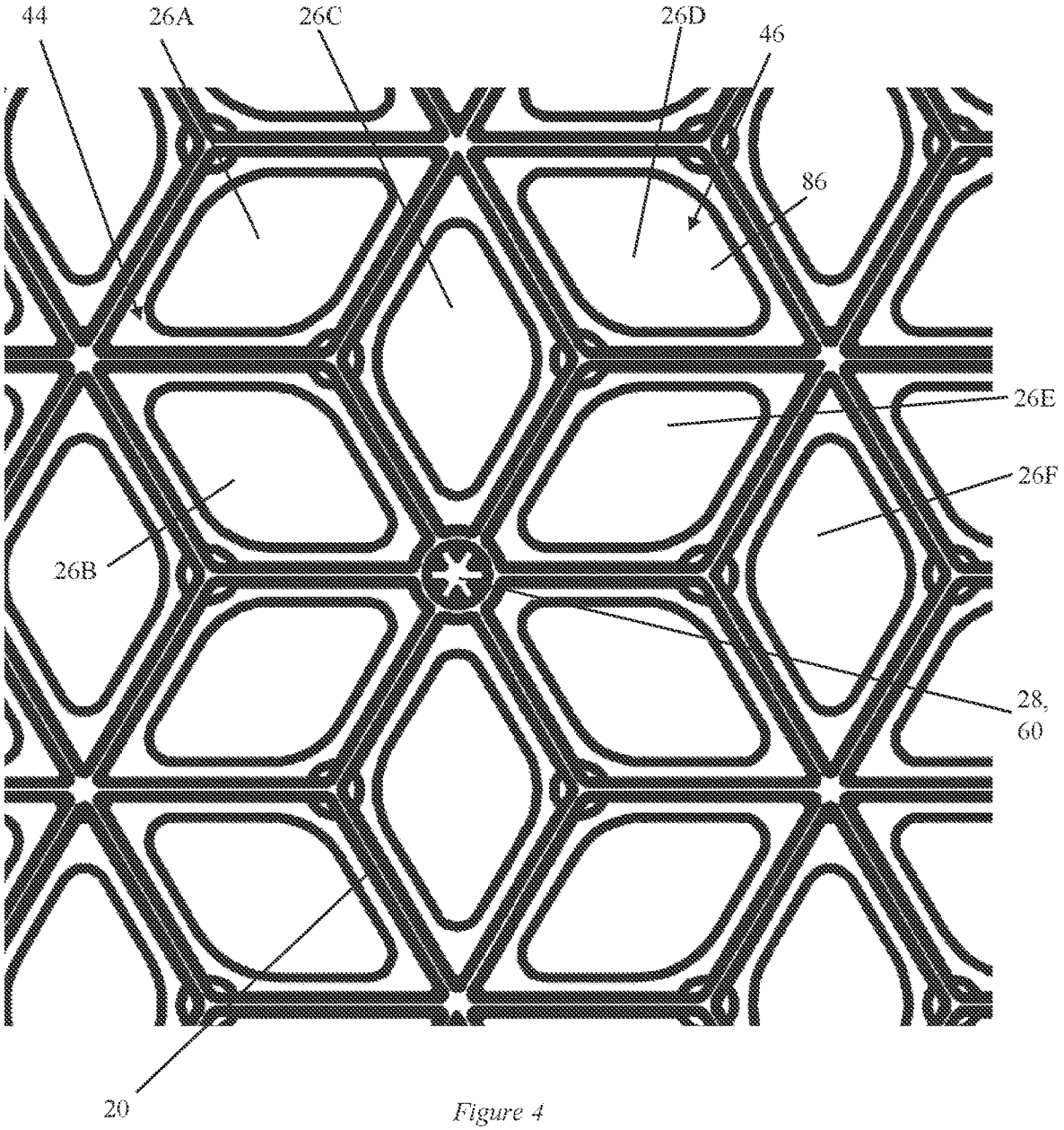
FIG. 4 is a close-up of a portion of a support product according to an embodiment of the present disclosure, showing a pattern of latticework walls and a cylindrical access cell.

Referring to FIGS. 2 and 4, a number of the walls 20 of the support structure 10 define a cell structure 36. The cell structure 36 comprises a plurality of cells 26. The cell structure 36 is repeated throughout at least part of the support product 10. In the illustrated embodiment, the cell structure 36 is repeated throughout the support product 10, with one instance of the cell structure 36 being immediately adjacent to a number of other instances of the cell structure 36. The adjacent cell structures 36 share a number of common walls 20. In other words, one particular wall 20 defines part of a cell 26 in one cell structure 36 and part of a cell 26 in an adjacent cell structure 36. That is, in some embodiments, each instance of the cell structure 36 shares at least one wall 20 in common with another instance of the cell structure 36.

The junctions 28 can also be used as reference points to define a planar shape of the cell structure 36. Specifically, a perimeter profile 38 of the cell structure 36 can be determined by connecting the junctions 28 of the cell structure 36 that fall on the perimeter of the cell structure 36 with straight lines (for example, as shown for one group of cells 26 forming a cell structure 36 in FIG. 2). In the illustrated embodiment, the perimeter profile 38 of the cell structure 36 forms an asymmetric polygon.

One or more of the cells 26 of the cell structure 36 is a quadrilateral. In other words, the cell perimeter profile 38 and/or the cell planar profile of one or more of the cells 26 of the cell structure 36 is a quadrilateral. In the illustrated embodiment, each of the cells 26 of the cell structure 36 is a quadrilateral. That is, the cell perimeter profile 28 and the cell planar profile of each of the cells 26 of the cell structure 36 is a quadrilateral.

One or more of the cells 26 of the cell structure 36 is symmetrical. One or more of the cells 26 of the cell structure 36 is regular. That is, each side of one or more of the cells 26 is of equal length.

Referring to FIG. 4, the cell structure 36 comprises a first cell 26A. The first cell 26A is a first shape. The first shape is defined, at least in part, by a first subset of the plurality of walls 20. The first subset of the plurality of walls 20 comprises a number of walls 20. The cell structure comprises a second cell 26B. The second cell is a second shape. The second shape is defined, at least in part, by a second subset of the plurality of walls 20. The second subset of the plurality of walls 20 comprises a number of walls 20.

The first cell 26A and the second cell 26B share at least one wall 20. That is, at least one of the walls 20 defines part of the first cell 26A and part of the second cell 26B. In other words, the second subset of the plurality of walls 20 comprises at least one wall 20 of the first subset.

The cell structure 36 comprises a first group of cells 44. The first group of cells 44 comprises the first cell 26A and the second cell 26B. The first cell 26A and the second cell 26B are symmetrical about a first axis of symmetry. In other words, the first group of cells 44 comprises the first axis of symmetry and the first shape mirrors the second shape about the first axis of symmetry. The first axis of symmetry is parallel to the longitudinal axis of the wall 20 that is shared by the first cell 26A and the second cell 26B. In particular, the first axis of symmetry extends along at least part of a wall 20 that is shared by the first cell 26A and the second cell 26B.

The cell structure 36 comprises a third cell 26C. The third cell is a third shape. The third shape is defined, at least in part, by a third subset of the plurality of walls 20. The third subset of the plurality of walls 20 comprises at least one wall 20 from the first subset. The third subset of the plurality of walls 20 comprises at least one wall 20 from the second subset. In the illustrated embodiment, the third subset comprises one wall 20 from the second subset and one wall 20 from the first subset. That is, the third cell 26C and the first cell 26A share a wall 20. Similarly, the third cell 26C and the second cell 26B share a wall 20.

The cell structure 36 comprises a fourth cell 26D. The fourth cell 26D is a fourth shape. The fourth shape is defined, at least in part, by a fourth subset of the plurality of walls 20. The fourth subset of the plurality of walls 20 comprises a number of walls 20. The cell structure comprises a fifth cell 26E. The fifth cell 26E is a fifth shape. The fifth shape is defined, at least in part, by a fifth subset of the plurality of walls 20. The fifth subset of the plurality of walls 20 comprises a number of walls 20.

The fourth cell 26D and the fifth cell 26E share at least one wall 20. That is, at least one of the walls 20 defines part of the fourth cell 26D and part of the fifth cell 26E. In other words, the second subset of the plurality of walls 20 comprises at least one wall 20 of the first subset.

The third subset of the plurality of walls 20 comprises at least one wall 20 from the fourth subset. The third subset of the plurality of walls 20 comprises at least one wall 20 from the fifth subset. In the illustrated embodiment, the third subset comprises one wall from the fourth subset and one wall from the fifth subset.

The cell structure 36 comprises a second group of cells 46. The second group of cells 46 comprises the fourth cell 26D and the fifth cell 26E. The fourth cell 26D and the fifth cell 26E are symmetrical about a second axis of symmetry. In other words, the second group of cells 46 comprises the second axis of symmetry and the fourth shape mirrors the fifth shape about the second axis of symmetry. The second axis of symmetry is parallel to the longitudinal axis of the wall 20 that is shared by the fourth cell 26D and the fifth cell 26E. In particular, the second axis of symmetry extends along at least part of a wall 20 that is shared by the fourth cell 26D and the fifth cell 26E.

The first group of cells 44 and the second group of cells 46 are symmetrical about a third axis of symmetry. That is, the first group of cells 44 mirror the second group of cells 46 with respect to the third axis of symmetry. The third axis of symmetry bisects the third cell 26C.

The walls 20 that define the first through fifth cells 26A-E together form a hexagonal wall profile. In particular, the hexagonal wall profile is an elongated hexagon. This wall 20 and/or cell 26 configuration can improve the performance of the support product 10 under compressive loads.

The cell structure 36 comprises a sixth cell 26F. The sixth cell 26F is a sixth shape. The sixth shape is defined, at least in part, by a sixth subset of the plurality of walls 20. The sixth subset of the plurality of walls 20 comprises at least one wall 20 from the fifth subset. In the illustrated embodiment, the sixth subset comprises one wall 20 from the fifth subset. That is, the fifth cell 26E and the sixth cell 26F share a wall 20.

It will be understood that the 'shape' of a cell 26A-F of the cell structure 36 described herein may refer to one or more of the three-dimensional shape, cell perimeter profile 28 and the cell planar profile of the relevant cell 26A-F. When referring to the three-dimensional shape, one or more of the first shape, second shape, third shape, fourth shape, fifth shape and sixth shape may be a rhombic prism. When referring to the cell perimeter profile or the cell planar profile, one or more of the first shape, second shape, third shape, fourth shape, fifth shape and sixth shape may be a rhombus.

Partial Keyway

The support product 10 comprises a partial keyway 50. The partial keyway 50 defines a re-entrant corner of the support product 10. The partial keyway 50 is configured to receive part of a key (not shown). The partial keyway 50 extends inwardly from an edge of the support product 10. In other words, the partial keyway 50 extends inwardly from one of the minor faces 63, 65, 67, 69 of the support product 10. The edge (which may be part of one of the edge regions 62, 64, 66, 68) may, in some embodiments, be said to comprise the partial keyway 50.

The partial keyway 50 is configured to inhibit outward motion of the key when the key is within the partial keyway. In other words, the partial keyway 50 is configured to inhibit movement of the key away from the support product 10 once the key is received within the partial keyway 50.

The partial keyway 50 is configured to be located adjacent to a partial keyway 50 of another support product 10 that is connected to the described support product 10, so that adjacent partial keyways 50 define a complete keyway 55 between connected support products 10. Partial keyways 50 of adjacent support products 10 may define a complete keyway 55 having a chevron shaped section.

The support product 10 comprises an edge wall 54. In particular, the plurality of walls 20 comprises the edge wall 54. The edge wall 54 defines an edge plane. The edge plane is parallel to the edge wall 54. In some embodiments, the edge plane is disposed at the relevant minor face 63, 65, 67, 69 and is parallel to that minor face 63, 65, 67, 69.

The partial keyway 50 is defined, at least in part, by some of the plurality of walls 20. The walls 20 that define the partial keyway 50 may be referred to as partial keyway walls 52. The support product 10 may therefore be said to comprise a plurality of partial keyway walls 52. The plurality of partial keyway walls 52 comprises a pair of offset partial keyway walls 56, 58. The pair of offset partial keyway walls 56, 58 comprises a first partial keyway wall 56 and a second partial keyway wall 58. The first partial keyway wall 56 is parallel to the second partial keyway wall 58. The first partial keyway wall 56 is offset from the second partial keyway wall 58 so that the first partial keyway wall 56 and the second partial keyway wall 58 are separated by a separation distance. The pair of offset partial keyway walls 56, 58 extend parallel to a first direction 57. The first direction 57 is transverse to the edge plane. That is, the first direction 57 and the edge plane are non-parallel.

The plurality of partial keyway walls 50 comprises a transverse partial keyway wall 70. The transverse partial keyway wall 70 extends between the pair of opposed partial keyway walls 56, 58. In other words, the transverse partial keyway wall 70 extends from one of the pair of offset partial keyway walls 56, 58 to the other of the pair of offset partial keyway walls 56, 58.

The first partial keyway wall 56 meets the edge wall 54 at a junction 28. This junction 28 may be referred to as a first junction. The first partial keyway wall 56 and the edge wall 54 define an acute angle at the first junction. At its other end, the first partial keyway wall 56 meets the transverse partial keyway wall 70 at a junction 28. This junction 28 may be referred to as a second junction. The first partial keyway wall 56 extends from the first junction to the second junction. The first partial keyway wall 56 and the transverse partial keyway wall 70 define an acute angle at the second junction.

The transverse partial keyway wall 70 meets the second partial keyway wall 58 at a junction 28. This junction 28 may be referred to as a third junction. The transverse partial keyway wall 70 extends from the second junction to the third junction. The transverse partial keyway wall 70 and the second partial keyway wall 58 define an obtuse angle at the third junction.

The second partial keyway wall 58 extends from the third junction to a wall end portion 72. In the embodiment illustrated in FIG. 3, the wall end portion 72 is a junction between the second partial keyway wall 58 and another edge wall. The second partial keyway wall 58 is longer than the first partial keyway wall 56. In the illustrated embodiment, the length of the second partial keyway wall 58 is double the length of the first partial keyway wall 56.

The second partial keyway wall 58 and the first partial keyway wall 56 define a keyway opening 76. In particular, the keyway opening 76 is defined by the first junction and the wall end portion 72 (which, in the illustrated case, is the junction between the second partial keyway wall 58 and the adjacent edge wall). The keyway opening 76 can be considered to be an opening in the edge region of the support product 10.

The illustrated support product 10 comprises a plurality of partial keyways 50. Each edge region 62, 64, 66, 68 comprises at least one partial keyway 50. In the illustrated embodiment, the first edge region 62 and the second edge region 66 each comprise ten partial keyways 50 and the second edge region 64 and the fourth edge region 68 each comprise four partial keyways 50.

In some embodiments, the first partial keyway wall 56 and the second partial keyway wall 58 may be non-parallel. For example, the first partial keyway wall 56 and the second partial keyway wall 58 may extend, with respect to each other, such that an angle is formed at an intersection of lines tangential each of the walls 56, 58. That is, the angle formed between a line extending along the first partial keyway wall 56 parallel to its longitudinal axis 21 may extend beyond the first partial keyway wall 56 and intersect a similar line extending along the second partial keyway wall 58 at an angle. The angle may be an acute angle. The angle may be a right angle. The angle may be an obtuse angle.

It will also be understood that although the first partial keyway wall 56 is shown as connected to the edge wall 54 at a junction 28, this may not necessarily be the case. In some embodiments, the first partial keyway wall 56 and/or the second partial keyway 58 wall may terminate at a free end. Alternatively, the first partial keyway wall 56 and/or the second partial keyway 58 may terminate at a junction with a wall that is non-parallel to the relevant minor face of the support product 10.

Planar Portion

The support product 10 comprises a planar portion 80. The planar portion 80 is generally planar. That is, the planar portion 80 is generally parallel to the axes of a reference plane. The reference plane is parallel to one of the major faces 14, 16 of the support product 10. In some embodiments, one of the major faces 14, 16 lies on the reference plane.

The planar portion 80 has a thickness in a direction that is generally perpendicular to the axes of the reference plane. The planar portion 80 extends, in the direction that is generally perpendicular to the axes of the reference plane, from a first planar portion face 82 to a second planar portion face 84 (see FIG. 6). The first planar portion face 82 may be referred to as a lower face of the planar portion 80. The second planar portion face 84 may be referred to as an upper face of the planar portion 80. One or both of the first planar portion face 82 and the second planar portion face 84 are generally parallel to the reference plane.

The planar portion 80 comprises a channel 86. The channel 86 extends from the first planar portion face 82 to the second planar portion face 84 to define a path through which fluid can flow through the planar portion 80. The channel 86 is aligned with a cell 26 to provide a path through which fluid can flow through the support product 10. The illustrated planar portion 80 comprises a plurality of channels 86, each aligned with a respective cell 26. Each channel 86 and cell 26 together provide a hole through the support product 10.

In some embodiments, the planar portion 80 may be considered to be part of the plurality of walls 20. That is, the walls 20 may be considered to have a thicker portion at their base end 31, with the thicker portion comprising the planar portion 80. When described in this way, it will be understood that the walls 20 may be considered to be thicker at a lower portion than at a higher portion.

In some embodiments, rather than the planar portion 80 being considered to be part of the walls 20, the walls 20 may be considered to be connected to the planar portion 80.

In some embodiments, the walls 20 are integrally formed with the planar portion 80. For example, the walls 20 and the planar portion 80 may be formed in an injection moulding process such that the walls 20 and the planar portion 80 form an integrated structure. The walls 20 project from the planar portion 80. In other words, the walls 20 extend away from the planar portion 80. As described herein, each of the walls 20 extends from a base end to an elevated end 33. The walls 20 are adjacent to the planar portion 80 at their base end 31. The elevated end 33 of a particular wall 20 is further away from the planer portion 80 than the base end 31 of that wall 20. The elevated ends 33 of the walls 20 define an elevated surface 43. The elevated surface 43 faces away from the planar portion 80.

Access Cell

The support product 10 comprises an access cell 60. The access cell 60 is generally cylindrical. In other words, a cross-sectional profile of the access cell 60 is circular. The access cell 60 may therefore be referred to as a cylindrical access cell 60. The access cell 60 is defined by a wall 20 of the support product.

The access cell 60 is configured to facilitate access below the support product 10. In particular, the access cell 60 is configured to enable access beneath the support product 10 once installed. The access cell 60 extends from the first major face 14 of the support product 10 to the second major face 16 of the support product 10. The access cell 60 is defined by a cylindrical wall 20. The access cell 60 is disposed at a junction 28 of the support product 10. In particular, the access cell 60 is disposed at a junction between the first group of cells 44, the second group of cells 46 and the third call 26C of the cell structure 36. In other words, a junction 28 between a number of the walls 20 of the plurality of walls 20 comprises the access cell 60.

The access cell 60 is configured to contain the fill material. The fill material may be removed if access underneath a section of pavement constructed using the support product 10 is required. For example, where the fill material is concrete, the concrete contained within the access cell 60 during use can be removed (e.g. with a drill), creating a channel through which a space underneath the support product 10 can be accessed. After the need to access underneath the support product is remediated, the access cell 60 can again be filled with the relevant fill material and the pavement can continue to be used.

The cylindrical access cell 60 may comprise protrusions into the cell to retain the hardened concrete cylinder and prevent it from being accidentally ejected. The illustrated access cell 60 comprises a plurality of inwardly projecting projections.

The illustrated support product 10 comprises a plurality of access cells 60.

Connecting Multiple Support Products

The support product 10 is configured to be connected to one or more other support products 10 during the construction of a path. Herein, a path may be considered to comprise one or more of a pavement and a granular track configured to enable the movement of vehicles or people. The support product 10 comprises a connection system 45 to facilitate this connection. The connection system 45 may comprise one part of a first support product 10 and another part of a second support product 10, with the parts of the respective support products 10 cooperating to enable the connection of the support products 10. This connection of the support products 10 may be referred to as a first connection. It may also be referred to as an initial connection of the support products 10. This connection is configured to enable the support products 10 to be aligned in a way that facilitates the construction of a second connection (which can involve the fill material and/or a key). When the support products 10 are connected using the connection system(s) 45, a number of the partial keyways 50 of the first support product 10 are aligned with the partial keyways 50 of the second support product 10, forming complete keyways 55.

The support product 10 comprises a catch 40. In particular, the connection system 45 may comprise the catch 40. The catch 40 is configured to connect with a catch 40 of an adjacent support product 10 to restrain relative movement of connected support products 10.

Each edge may comprise at least one catch 40 and at least one partial keyway 50, wherein partial keyways 50 of opposed edges are symmetrical.

In other words, each edge region 62, 64, 66, 68 comprises at least one catch 40. Each edge region 62, 64, 66, 68 also comprises at least one partial keyway 50.

Each edge may comprise at least two partial keyways 50. Each edge region 62, 64, 66, 68 may comprise at least two partial keyways 50.

Each edge may comprise at least four partial keyways 50. Each edge region 62, 64, 66, 68 may comprise at least four partial keyways 50.

Each edge may comprise at least two catches 40. Each edge region 62, 64, 66, 68 may comprise at least four catches 40.

Each edge may comprise at least four catches 40. Each edge region 62, 64, 66, 68 may comprise at least four catches 40.

Each catch 40 may be either a first part or a second part.

The first part may be a male pin and the second part may be a female slot.

Figure 3:
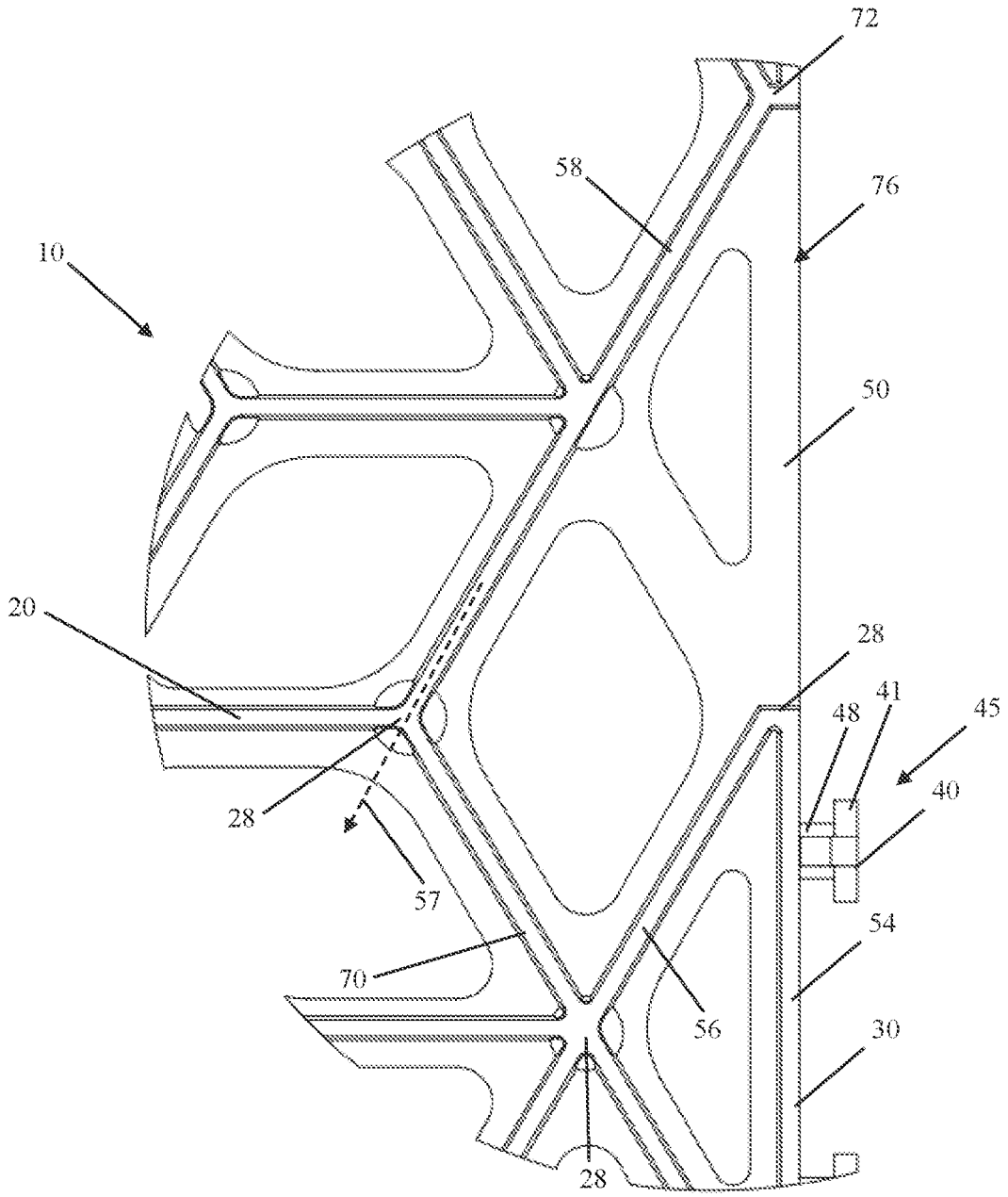
FIG. 3 is a close-up of region 'A', depicting the edge of a support product according to an embodiment of the present disclosure, showing a catch and a partial keyway.

In some embodiments, the catch 40 comprises an outer catch portion 41 (see FIG. 3). The outer catch portion 41 has a first width. The catch 40 comprises an inner catch portion 48. The inner catch portion 48 has a second width. The first width is greater than the second width. Such a catch 40 may be referred to as a male catch. The male catch projects outwardly from one of the minor faces of the support product 10.

In some embodiments, the catch 40 comprises a groove. The groove is a groove in one of the walls 20 of the support product. For example, the edge wall 24 may comprise the groove. The groove is configured to receive a male catch.

The illustrated embodiment of the support product 10 comprises a plurality of male catches and a plurality of female catches. The plurality of male catches project outwardly from one or more walls 20 of an edge region 62, 64, 66, 68. The plurality of female catches are located on one or more walls of an edge region 62, 64, 66, 68 that is adjacent to the edge region 62, 64, 66, 68 from which the plurality of male catches project outwardly. In some embodiments, a pair of opposed edge regions 62, 64, 66, 68 comprise male catches and another pair of opposed edge regions 62, 64, 66, 68 comprise female catches.

In another embodiment, the first part may be an over hook and the second part may be an under hook.

A pair of adjacent edges of the support product 10 may comprise catches 40 having a first part, and an opposed pair of adjacent edges of the support product 10 may comprise catches 40 having a second part, to facilitate assembly of a large number of support products 10.

In another embodiment, each catch 40 is comprised of a slot, and support products are connected using an intermediary connector 42.

The intermediary connector 42 may be cotton reel shaped, having wider ends and a narrower mid-portion.

As described herein, multiple support products 10 are connected together using the connection systems 45 provided on each support product 10. Partial keyways 50 of adjacent support products 10 may define a complete keyway 55 having a shape configured to prevent separation of adjacent support products 10.

After the support products 10 are connected using the connection systems 45 of the multiple support products (e.g. with one support product 10 including a male catch that is aligned with, and connected to a female catch of another support product 10), the fill material can be provided. Multiple connected support products 10 are shown, by way of example, in FIG. 8.

In some embodiments, the fill material comprises a cementitious material. In such embodiments, the fill material can be poured onto the support product 10 so that it fills the cells 26 and the complete keyways 55. Once the cementitious material cures, the hardened cementitious material within a complete keyway 55 will act as a key that inhibits relative movement of the connected support products 10.

In some embodiments, the fill material can be a granular fill material such as gravel. In such embodiments, a key can be inserted into one or more of the complete keyways 55 formed when the multiple support products 10 are connected together using the relevant connection systems 45. The key may be a metal part, a ceramic part, a concrete part, or a part comprising another material. The key is shaped to be received within a complete keyway 55. Once the keys are inserted, the fill material can be provided, and the cells 26 can be filled with the fill material. In this case, the keys can inhibit relative movement of the connected support products in use.

Pavement Course

Figure 7:
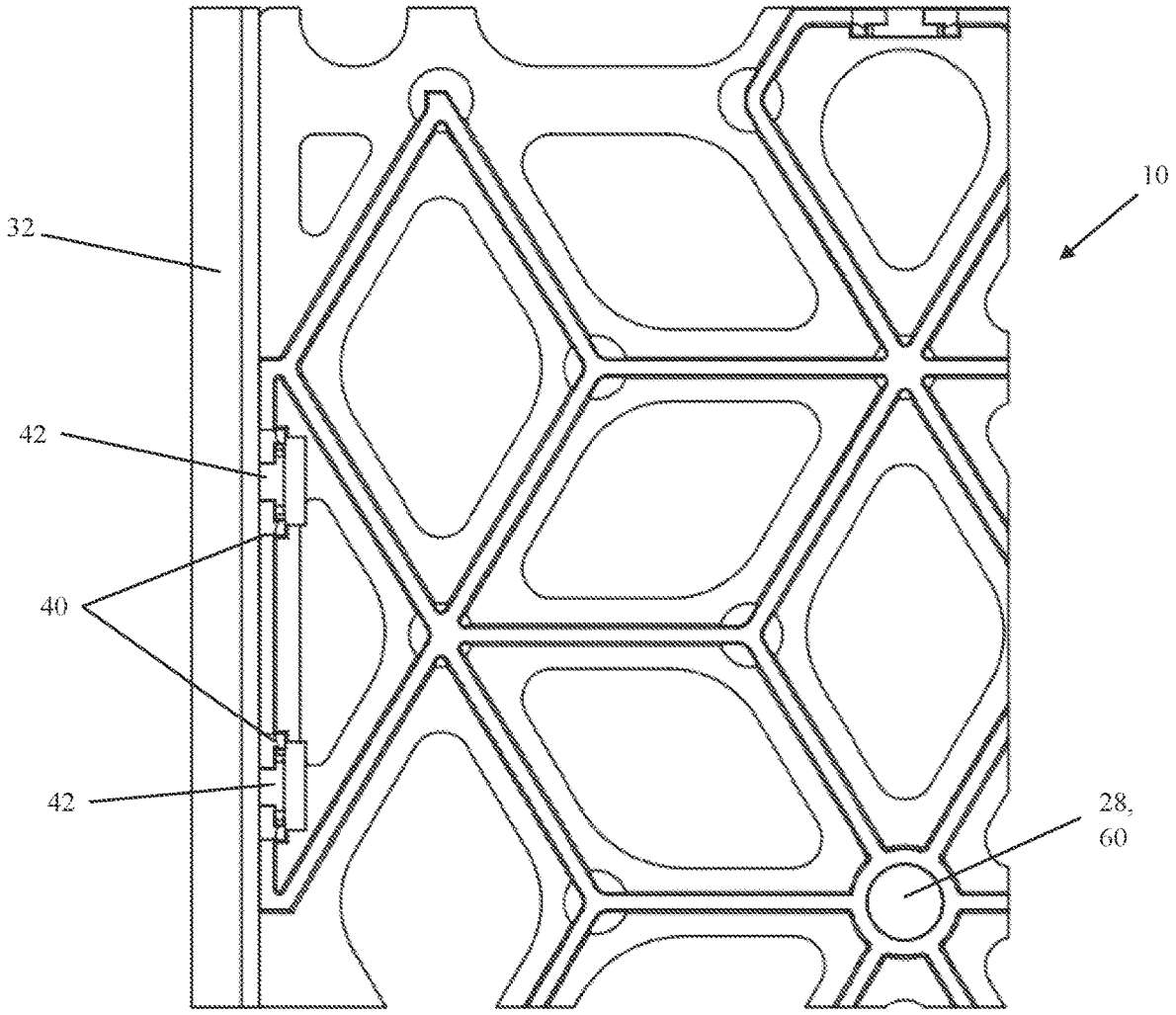
FIG. 7 is a plan view showing an edge formwork piece connected to a support product according to an embodiment of the present disclosure.
Figure 8:
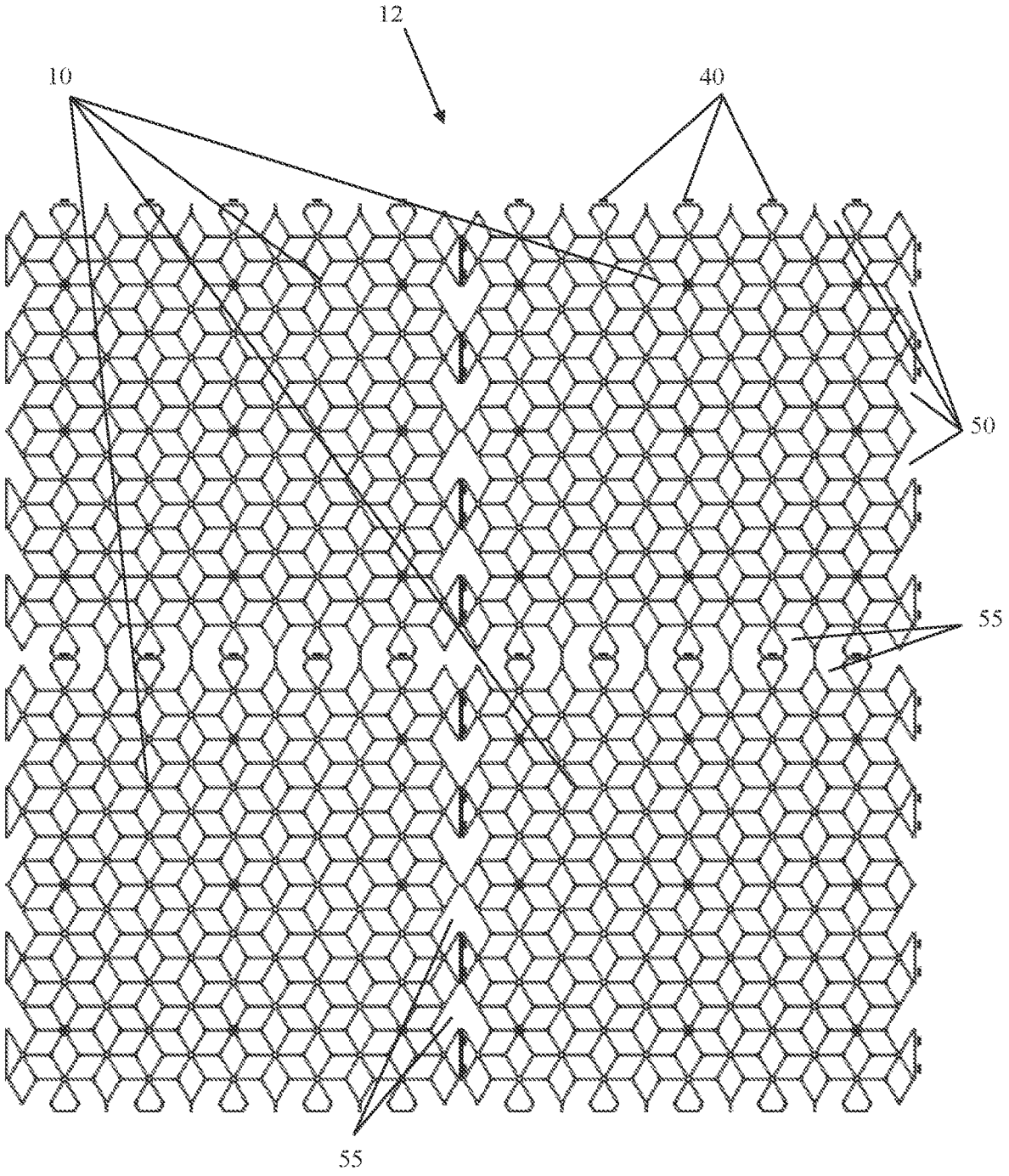
FIG. 8 is a plan view showing a pavement comprising an array of connected support products according to an embodiment of the present disclosure, to illustrate the pattern once the support products have been filled with concrete.

Referring to FIGS. 6 to 8 there is provided a pavement course according to an embodiment of the present disclosure, the pavement course comprising a plurality of connected support products 10, wherein each support product 10 comprises; a latticework of walls 20 and a plurality of edges 30, wherein the walls 20 extend between a lower surface 22 and an upper surface 24 and define a plurality of cells 26, wherein at least one edge comprises a catch 40 and a partial keyway 50, wherein adjacent support products 10 are connected by respective catches 40 to restrain relative movement, and wherein the partial keyway 50 is located adjacent to a partial keyway 50 of a connected support product 10, so that adjacent partial keyways 50 define a complete keyway 55 between connected support products 10, and wherein the pavement course comprises concrete extending from the lower surface 22 to the upper surface 24 so that the cells 26 and keyways 55 are substantially filled with concrete.

In other words, the support product 10 described herein may be used in the construction of a path. The path may be referred to as a pavement course. The path comprises a plurality support products 10 that are connected together at their respective edge regions 62, 64, 66, 68. The connected support products 10 are filled with a fill material, and, if required, one or more keys, to form the path.

The pavement course may further comprise an edge formwork piece 32. The edge formwork piece 32 is configured to connect to catches 40 of the support products 10 at the edges of the pavement course. The edge formwork piece 32 defines an edge of the pavement course.

In one embedment, the edge formwork piece 32 may be constructed of a constant section, having a slot configured to receive an intermediary connector 42.

In another embodiment, the edge formwork piece 32 may comprise catches configured to connect with catches 40 of the support product 10.

The fill material may be provided to the connected support products 10 after the connection of the necessary edge formwork pieces 32 to the edge regions of the support products 10 forming edges of the path.

Method of Constructing a Pavement Course

In accordance with another aspect of the present disclosure there is provided a method of constructing a pavement course. As described herein, the pavement course may be, more generally, described as a path. The pavement course comprises a plurality of connected support products 10. Each support product 10 comprises a latticework of walls 20 and a plurality of edges 30. The walls 20 extend between a lower surface and an upper surface and define a plurality of cells 26. At least one edge 30 comprises a catch 40 and a partial keyway 50. Each partial keyway 50 is configured to be located adjacent to a partial keyway 50 of a connected support product 10, so that adjacent partial keyways 50 define a complete keyway 55 between connected support products 10.

The method comprises one or more of the following steps:

a. Connecting a plurality of support products 10 using adjacent catches 40, to create an array 12 substantially spanning an area for which the pavement course is to be provided,
b. Pouring concrete onto the array 12, so that the cells 26 and complete keyways 55 of the array 12 of support products 10 are substantially filled with concrete,
c. Allowing the concrete to set.

The method may comprise the following step after step b:

b. Levelling the upper surface using a vibrating screed.

The method may comprise the following step after step c:

c. once the concrete has hardened, finishing the upper surface using a chopper.

Described differently, the method comprises connecting a plurality of the support products 10. The relevant connection systems 45 may be used, as described herein. The support products 10 may be connected to form an array 12 of support products 10.

As described herein, the support product 10 is configured to be aligned with a second support product 10 such that the partial keyway 50 of the support product 10 and a partial keyway of the second support product 10 form a complete keyway 55. The complete keyway 55 may be referred to as a keyway. The keyway is configured to receive a key. In use, the partial keyway walls 52 are configured to cooperate with the key to inhibit relative movement of the support product 10 and the second support product 10, as described herein. This is, at least in part, as the partial keyway 50 extends inwardly from an edge of the support product 10.

In use, a plurality of support products 10 are located adjacent one another and connected using the catches 40 on their respective edges 30.

The connected support products 10 create an array 12. The array 12 may be said to have latticework walls 20 extending across the area designated for the pavement course 100. The array of support products 10 may cover an area over which it is desired to form a path.

The support products 10 may be laid upon subgrade, sub-base or base course, and may therefore be able to substitute different courses.

The base course may further have cracker dust, also known also crusher dust, applied and compacted, before the support products 10 are laid.

Where edges of the area do not align with edges 30 of the support products 10, support products 10 may be cut to suit.

Edge formwork 32 pieces may be connected to support products 10, thus providing integrated formwork and removing the requirement for conventional formwork.

The method comprises providing a fill material to the support products 10. The fill material is provided so that its received within the cells 26 (and where relevant, the complete keyways 55). As described herein, if the fill material is not to be used as a key, separate keys can be included in the complete keyways 55 prior to providing the fill material.

If the fill material requires curing, the method can comprise allowing the fill material to cure after being received within the cells 26.

In some embodiments, the method comprises levelling the path using a vibrating screed. In other words, the connected support products 10, which are filled 3 with a concrete mix, may be levelled at the upper surface using a vibrating screed. Further, an upper surface of the path may be finished. The upper surface may be finished using a chopper. In other words, once hardened, the concrete of the embodiments involving concrete may be finished using a chopper.

Method of Repairing a Pavement Course

In accordance with another aspect of the present disclosure there is provided a method of repairing a void in a pavement course. The pavement course comprises a plurality of connected support products 10. Each support product 10 comprises; a latticework of walls 20, a cylindrical access cell 60 and a plurality of edges. The walls 20 extend between a lower surface and an upper surface and define a plurality of cells 26. At least one edge 30 comprises a catch 40 and a partial keyway 50. Adjacent support products 10 are connected by respective catches 40 to restrain relative movement. The partial keyway 50 is located adjacent to a partial keyway 50 of a connected support product 10, so that adjacent partial keyways 50 define a complete keyway 55 between connected support products 10. The pavement course comprises concrete extending from the lower surface to the upper surface. The cells 26 and keyways 55 are substantially filled with concrete. The method comprises the following steps:

d. Drilling through the concrete of a cylindrical access cell 60, wherein the cylindrical access cell 60 is located above the void 110 to be repaired, e. Injecting filler product into the void 110 until the void 110 and the cylindrical access cell 60 are substantially filled.

In other words, where a path constructed using the support product 10 described herein is experiencing degradation, for example, by way of a void developing under the section of the path that comprises the support product 10, the support product 10 enables the path to be repaired. The path can be repaired using a method, as described herein.

Specifically, the fill material contained within the access cell 60 can be removed. This can be done, for example, with a drill. The access cell 60 will provide a path underneath the relevant support product following removal of the fill material. A filler product can then be injected into the void that has developed under the path. The 33 filler product can be injected to fill the void. Once the void is filled, new fill material can be provided into the access cell 60 to return the path to an operational state. This method, and the provision of the access cell 60, enable the path to be repaired inexpensively, and without significant structural disruption to the rest of the path.

Advantages

The support product 10 described herein provides a number of significant advantages.

Existing flexible pavements require a significant volume of material and excavated depth. Higher material volumes and exaction depths result in associated increased costs of construction. Damage to flexible pavements is also common.

Rigid pavements are adversely affected by temperature changes, which can cause expansion and subsequent cracking of the rigid pavements. Rigid pavements can also be relatively expensive to construct and difficult to repair.

The support product 10 described herein can enable the construction of a path such as a pavement for the conveyance of traffic that provides benefits that are typically only provided by one of flexible pavements or rigid pavements.

The inclusion of the support product 10 enables the path which is ultimately constructed using the support product 10 to flex, as the support product 10 is generally less rigid than a concrete or steel re-enforced concrete path. As the cells 26 of the support product 10 are filled with fill material, the compressive strength of the fill material can be utilised in use, whilst the flexibility of the support product 10 enables the path to flex when under load. A path constructed using the support product 10 can therefore provide benefits that are traditionally provided by only one of flexible pavements and rigid pavements. That is, a path constructed using the support product 10 can provide the benefits of a rigid pavement (e.g. where the fill material is concrete), whilst also providing the benefits of a flexible pavement, at least in part due to the flexibility provided by the support product 10 and the way the support product 10 divides the path into cells 26 of rigid fill material. Such characteristics can reduce the wear experienced by the path over time, and can lead to an increase in the working lifespan of a path constructed using the support product 10.

The support product 10 enables the construction of a path that can support a high load whilst sustaining a reduced amount of damage. For example, a path 3 constructed using an array of connected support products 10, in combination with concrete as a fill material, can provide sufficient structural integrity for a concrete truck to drive across without disturbing the subjacent base courses.

The construction of such a path using conventional methods could require a significant volume of concrete. The described support product 10, and the described method of constructing a path using the support product 10 therefore remove or reduce the requirement for an expensive concrete pump in some instances, for example on a large expanse of pavement area.

Further, a composite pavement course constructed as described herein, comprised of support products 10 filled with a fill material, can achieve a large tensile load bearing capacity, when compared to known conventional flexible and rigid pavement courses.

A pavement course of support products 10 having a thickness of 40 mm between the upper surface and lower surface, filled with a 32 MPa rated concrete mix, has been shown to have compressive strength of 107 MPa without cracking. Thus, high strength paths of reduced thickness can be constructed using the support product 10 and an appropriate fill material. The pavement course constructed using support products 10 according to the present disclosure therefore requires less concrete per unit area of the path, due to the reduced thickness.

In other words, the support product 10 described herein enables the construction of paths with a relatively small vertical profile (i.e. depth, and therefore, corresponding excavation requirements), that are capable of supporting the transport of heavy vehicles. Such paths can be constructed using a reduced amount of materials, which can significantly reduce the cost of producing such a path, and the logistical difficulties associated with constructing such paths.

The openings 34 of the support product 10 advantageously enable fill material to flow between cells 26 during construction. This enables the fill material to settle at a relatively constant height throughout the path that is being constructed.

No formwork or additional concrete reinforcement is required, saving both time and cost.

In the example detailed above with an illustration of the compressive strength of a pavement course constructed using the support product, the concrete required is approximately 0.04 m3 per square metre, significantly less than either a conventional rigid pavement or flexible pavement. Further, the reduced thickness of the pavement course requires less excavation and material than conventional pavements. Less excavation means less expensive heavy machinery, lower risk of hitting or disrupting underground services, and reduced schedules.

The load profile of a pavement course according to the present disclosure is similar to a rigid pavement, as depicted in FIG. 1*c*, with the load being spread due to the tensile stress being carried through the support product filled with concrete.

As such, any defects or voids beneath the pavement course 10 are shallower than would be experienced by flexible pavements.

In addition, due to higher tensile strength, the pavement course 100 has a greater loading capacity and may continue to operate with a defect below the pavement course 100, for a longer period without failure which requires repair, than conventional pavements.

In the event of a void appearing under the pavement course 100, access beneath the pavement course 100 can be provided by removing a single cell of concrete, and injecting a suitable filler product to fill the void. Further, prior to repair, the flexibility of the support product 10 enables the path to flex to partially accommodate the void. This can reduce damage to the composite pavement (i.e. the support product filled with fill material) caused by damage underneath the pavement.

Once cured, the pavement constructed using support products 10 according to the present disclosure is comprised of a plurality of cured concrete cells 26 and keyways interconnected by the support product 10.

The combination provides structural integrity significantly exceeding conventional pavements at lower thickness.

Importantly, the partial keyways 50 between each support product 10 allow concrete keys to form across connecting edges, so that connected support products 10 are restrained.

This removes the requirement for conventional ties or steel dowels, and allows the construction of a concrete pavement course with no movement or expansion joints required.

The term concrete, as used throughout the specification, is intended in an inclusive sense to include any cementitious or bituminous product. The term concrete is also intended to include Modifications and variations as would be apparent to a skilled addressee are deemed to be within the scope of the present disclosure.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the disclosure.

The invention claimed is:

1. A support product for receiving a fill material in construction of a path, the support product comprising:
- a plurality of walls, at least some of the plurality of walls defining cells, the plurality of walls comprising:
- an edge wall defining an edge plane that is parallel to the edge wall; and
- a plurality of partial keyway walls defining a partial keyway, the plurality of partial keyway walls comprising:
  - a pair of offset partial keyway walls that extend parallel to a first direction that is transverse to the edge plane, the pair of offset partial keyway walls comprising:
    - a first partial keyway wall; and
    - a second partial keyway wall; and
    - a transverse partial keyway wall extending from one of the pair of offset partial keyway walls to the other of the pair of offset partial keyway walls;

wherein:
- the first partial keyway wall meets the edge wall at a first junction;
- the first partial keyway wall and the edge wall define an acute angle at the first junction; and
- the support product is configured to be aligned with a second support product such that the partial keyway and a second partial keyway of the second support product form a keyway configured to receive a key.

2. The support product of claim 1, wherein the support product is part of a path.

3. The support product of claim 1, wherein the first partial keyway wall and the transverse partial keyway wall define an acute angle therebetween.

4. The support product of claim 1, wherein the transverse partial keyway wall and the second partial keyway wall define an obtuse angle therebetween.

5. The support product of claim 1, wherein the second partial keyway wall is longer than the first partial keyway wall.

6. The support product of claim 1, wherein the partial keyway defines a re-entrant corner of the support product.

7. The support product of claim 1, further comprising a male catch that projects outwardly, the male catch comprising:

an outer catch portion of a first width; and an inner catch portion of a second width;

wherein the first width is greater than the second width.

8. The support product of claim 1, further comprising a female catch in the form of a groove in one of the walls of the plurality of walls.

9. The support product of claim 1, wherein the support product comprises:

opposed major faces comprising a first major face and a second major face; and a plurality of edge regions;

wherein each edge region comprises a respective minor face of the support product and one of the edge regions comprises the partial keyway.

10. The support product of claim 1, further comprising a polymer.

11. The support product of claim 1, wherein:

the first partial keyway wall extends from the first junction to a second junction, the second junction being a junction between the first partial keyway wall and the transverse partial keyway wall; and the second partial keyway wall extends from a third junction to a wall end portion, the third junction being a junction between the transverse partial keyway wall and the second partial keyway wall;

wherein a keyway opening is defined between the first junction and the wall end portion.

12. The support product of claim 11, wherein the wall end portion is a junction between the second partial keyway wall and another edge wall.

13. The support product of claim 1, wherein the plurality of walls defines a cell structure, the cell structure being repeated throughout at least part of the support product;

wherein:

each wall of the plurality of walls meets another wall of the plurality of walls at a junction; and a perimeter profile of the cell structure determined by connecting junctions with straight lines forms an asymmetric polygon.

14. The support product of claim 13, wherein each instance of the cell structure shares at least one wall in common with another instance of the cell structure.

15. The support product of claim 1, further comprising an access cell that is configured to enable access beneath the support product.

16. The support product of claim 15, wherein a junction between a number of the walls of the plurality of walls comprises the access cell.

17. The support product of claim 15, wherein a cross-sectional profile of the access cell is circular.

18. The support product of claim 15, wherein the access cell comprises inwardly projecting projections.

19. The support product of claim 1, wherein the support product is part of a pavement course.

20. The support product of claim 19, wherein the pavement course further comprises a fill material, wherein:

the cells contain the fill material; and the fill material comprises one or more of:

a cementitious material;

a bituminous material; and a granular fill material.

* * * * *